US005118015A

United States Patent [19]

Scholle et al.

[11] Patent Number: 5,118,015

[45] Date of Patent: * Jun. 2, 1992

[54] METHOD AND APPARATUS FOR DISPENSING LIQUID

[75] Inventors: William R. Scholle, Corona Del Mar; Chester Savage, Irvine, both of Calif.; William A. Hardwick, Jr., Boerne, Tex.

[73] Assignee: Scholle Corporation, Irvine, Calif.

[ * ] Notice: The portion of the term of this patent subsequent to Dec. 11, 2007 has been disclaimed.

[21] Appl. No.: 417,328

[22] Filed: Oct. 5, 1989

Related U.S. Application Data

[63] Continuation-in-part of Ser. No. 403,189, Sep. 5, 1989, Pat. No. 4,976,381, which is a continuation-in-part of Ser. No. 298,368, Jan. 18, 1989, abandoned.

[51] Int. Cl.[5] ..... B67D 3/00; B67D 3/04

[52] U.S. Cl. ..... 222/484; 222/397; 222/519

[58] Field of Search ..... 222/484, 519, 552, 553, 222/549, 397, 464, 211, 382

[56] References Cited

U.S. PATENT DOCUMENTS

| | | | |
|---|---|---|---|
| 1,054,146 | 2/1913 | Smirle | 222/484 X |
| 1,911,076 | 5/1933 | Gandola | 222/484 |
| 2,405,681 | 8/1946 | Woock | 222/400 |
| 2,424,101 | 7/1947 | Lari | 222/519 |
| 2,708,058 | 5/1955 | Duval et al. | 222/482 |
| 2,842,291 | 7/1958 | Duval et al. | 222/332 |
| 2,992,761 | 7/1961 | Sommers, Sr. | 222/479 |
| 3,207,388 | 9/1965 | Waddington et al. | 222/484 |
| 3,223,296 | 12/1965 | Waddington et al. | 222/442 |
| 3,258,160 | 6/1966 | Allen | 222/484 X |
| 3,279,660 | 10/1966 | Collar | 222/397 |
| 3,752,369 | 8/1973 | Robert | 222/481 |
| 4,619,377 | 10/1986 | Roos | 222/83 |
| 4,802,610 | 2/1989 | Cheek et al. | 222/481.5 |
| 4,807,785 | 2/1989 | Pritchett | 222/484 X |
| 4,976,381 | 12/1990 | Scholle et al. | 222/484 |

FOREIGN PATENT DOCUMENTS

| | | | |
|---|---|---|---|
| 112938 | 7/1984 | European Pat. Off. | 222/484 |
| 2608722 | 6/1988 | France | 222/484 |

*Primary Examiner*—Donald T. Hajec

*Attorney, Agent, or Firm*—Richard F. Carr; Richard L. Gausewitz; Allan Rothenberg

[57] ABSTRACT

A container of draft beer is substantially filled with beer having a volume of dissolved carbon dioxide greater than 2.6 and not more than 3.1 times the volume of beer. The beer is packaged in a plastic container that is slightly permeable to carbon dioxide, but retains a satisfactory dissolved carbon dioxide content even after a normal shelf life. Beer is dispensed by gravity, without use of external pressure source, after release of head space pressure. Moreover, when the container contents are partially dispensed by the consumer and then maintained at appropriate low temperature for several days, the remaining beer still retains a satisfactory volume of dissolved carbon dioxide. A spigot on the container employs a barrel valve closure member that seals the pressurized container and is movable to a pressure release position in which pressurized gas within the container is slowly released without forcibly projecting container contents. The barrel valve closure is movable to a dispensing position in which the contents of the container are smoothly dispensed while air is admitted to avoid a blocking vacuum.

21 Claims, 9 Drawing Sheets

FIG. 3.
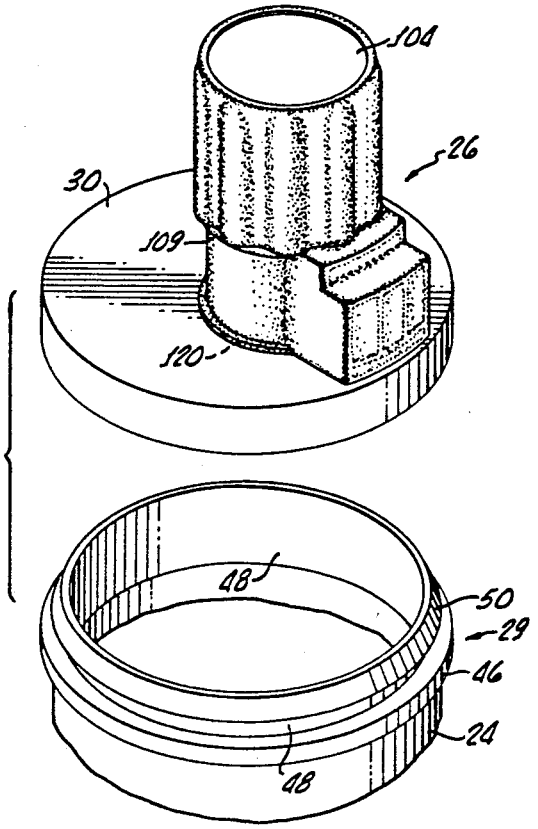
FIG. 4.
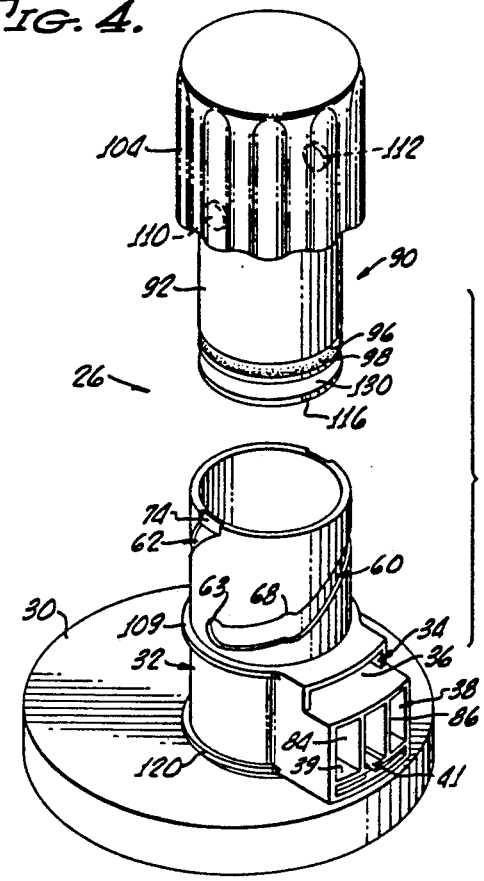
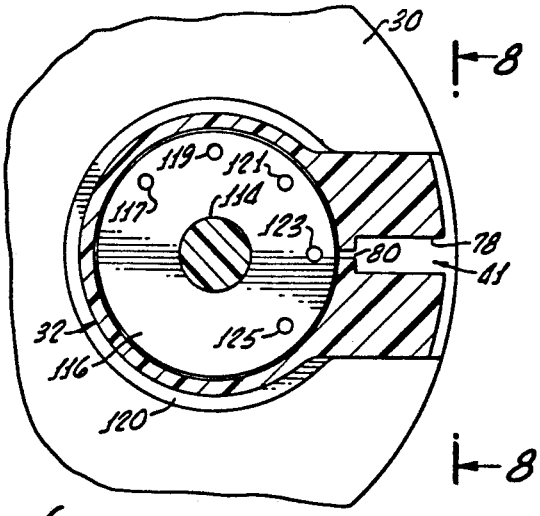
FIG. 7.
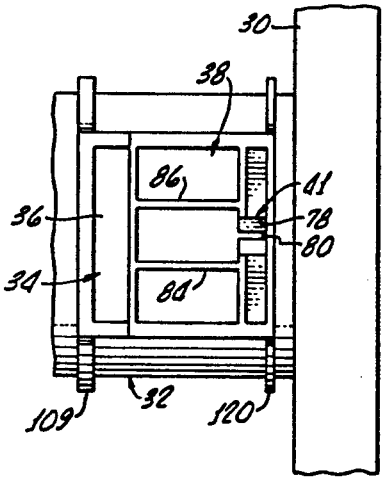
FIG. 8.

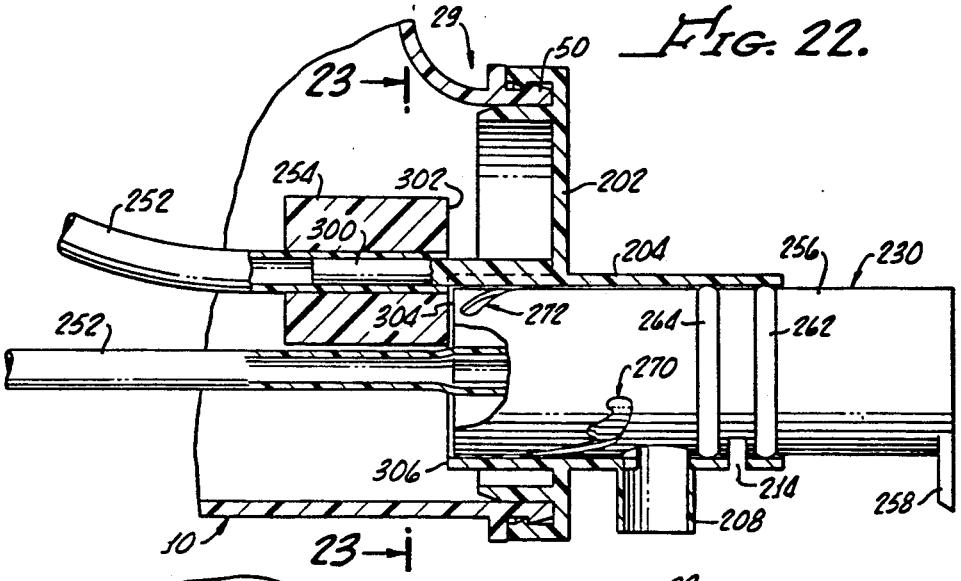
FIG. 22.
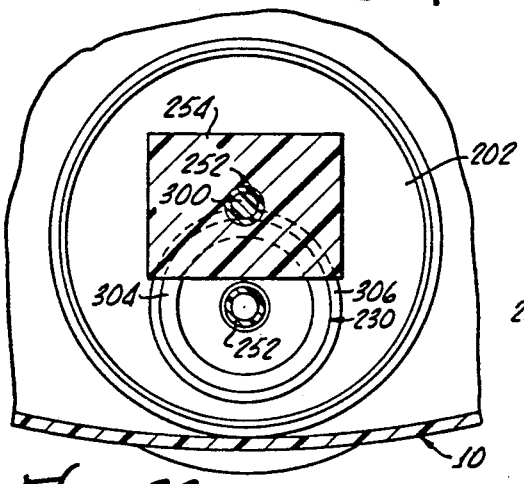
FIG. 23.
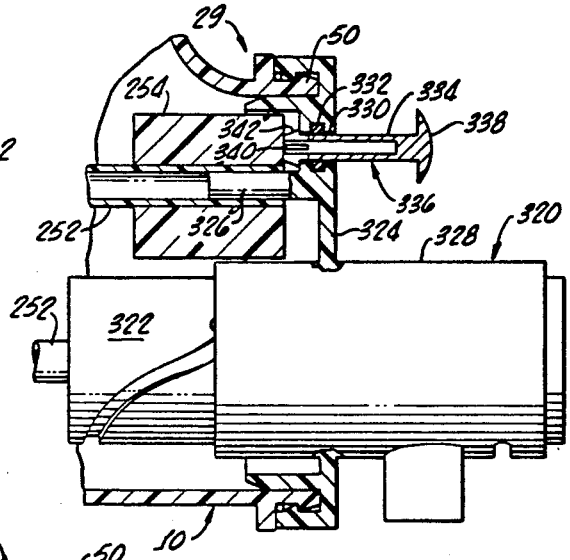
FIG. 25.
FIG. 24.
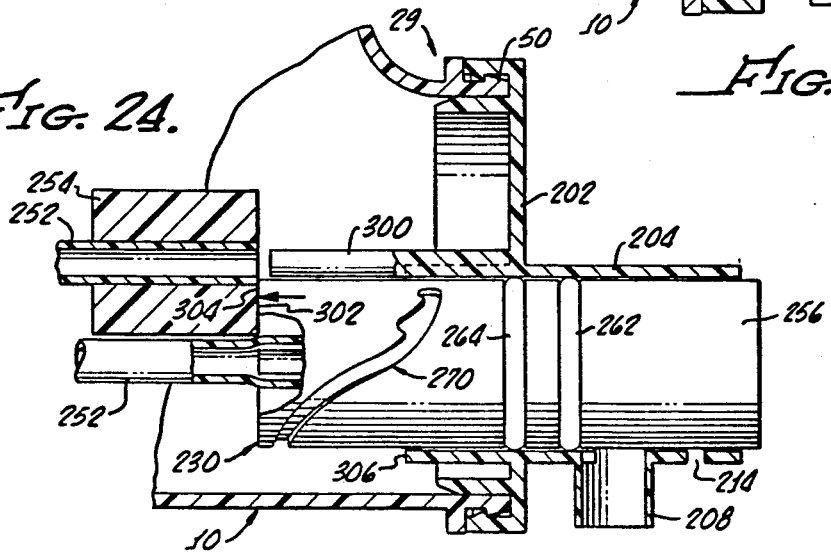

METHOD AND APPARATUS FOR DISPENSING LIQUID

This application is a continuation-in-part of application Ser. No. 403,189, filed Sep. 5, 1989 for Method and Apparatus for Dispensing Liquid, now U.S. Pat. No. 4,976,381 which in turn is a continuation-in-part of application Ser. No. 298,368, filed Jan. 18, 1989, for Method and Apparatus for Dispensing Liquid, now abandoned.

BACKGROUND OF THE INVENTION

The present invention relates to packaging and dispensing of liquid, and more particularly concerns packaging of draft beer for optimum retention of carbon dioxide and improved dispensing.

Draft beer sold in retail outlets is dispensed from commercial metal containers that are connected to a source of pressurized gas. The commercial container has a complex spigot having internal baffling designed to control foam produced when beer is dispensed. Such spigots are expensive. In smaller containers, relatively small diameter baffle tube or "pigtail" extends from the spigot toward the bottom of the container to control foam. The barrel is pressurized by a suitable gas, such as carbon dioxide, nitrogen or air, and dispensing of contents of the container is provided under the force of the internal pressure of the container. Draft beer marketed for home use must be provided with similar pressurizing equipment or the beer must be consumed quickly from an opened container. In some arrangements, for home dispensing, a hand pump is provided or sometimes even sold with the beer container, so that the container may be repeatedly pressurized with air from the pump to enable dispensing of the contents. In general in such prior systems, the beer is dispensed only by the force of the internal pressurization.

Such internal pressurization is the source of a number of disadvantages with regard to economy of manufacture, convenience and safety. With an internal small diameter tube attached to the spigot, it is more difficult, in the capping of the filled container to locate the tube through the opening of the container and to attach the cap. It is inconvenient and more costly to have to use some type of pressurizing pump or gas cartridge to maintain an adequate internal pressure at all times. Where a pump is employed for home use, strength of the container becomes important to avoid over pressurization of the container by a consumer and the attendant danger of explosion of a weak or defective container when over pressurized accidentally. Further, beer dispensed under such pressurization may foam excessively, particularly when a nearly empty bottle is further pressurized by a hand pump to dispense the last of the beer.

To avoid such problems and inconvenience, expense and danger, attempts have been made to package draft beer for sale to the consumer in containers that do not need to be pressurized for dispensing of beer, but still other problems have arisen in this type of packaging.

Draft beer, when packaged for sale directly to the consumer, must have a shelf life of some 30 to 60 days, and yet retain a sufficient content of dissolved carbon dioxide so as not to be "flat" when opened by the consumer. However, where the beer is packaged in a plastic container, permeability of the container to carbon dioxide may cause an unacceptable loss of gas from the package during normal shelf life. Further, when contents of the package have been partially dispensed by the consumer and it is desired to store the package with the remaining contents for two or three days, there is a further loss of carbon dioxide and degradation of palatability. It is generally found that the remaining contents, when dispensed after the previously opened packaged has been re-sealed and stored for some time, will be flat and less palatable because of the lack of carbon dioxide content.

In the dispensing of draft beer through the spigot of a container that is not connected to an outside pressurizing source, beer flowing out tends to create a vacuum within the container, thereby stopping the flow, or at least preventing a smooth nonfoaming flow, unless adequate venting is provided. Spigots of the prior art beer containers have not provided satisfactory venting.

Initial opening and pressure release are other problems encountered with the small draft beer containers sold for consumer use. Pressure within a container of draft beer is rapidly released when the container seal is broken for initial dispensing of the beer. Such sudden pressure release may result in a projected spray of beer and gas for some distance from the container, unless the container is opened very slowly and with great care. It is difficult to avoid such undesirable spray when opening a container having presently known spigots.

Accordingly, it is an object of the present invention to provide a draft beer package and an improved spigot that will avoid or minimize above-mentioned problems.

SUMMARY OF THE INVENTION

In carrying out principles of the present invention in accordance with a particular embodiment thereof, draft beer is packaged in a pressurized container which, immediately prior to use, is depressurized by venting pressure of the container head space through a pressure release port, so that the internal pressure of the container is substantially atmospheric and the beer is dispensed under the force of gravity, while providing venting to forestall the creation of a blocking vacuum. Draft beer is packaged in a container by filling the container with beer having a dissolved carbon dioxide volume that is between 2.6 and 3.1 times the volume of the beer. The container is pressurized during the filling operation to help contain the carbon dioxide dissolved in the beer during handling and shelf storage. Thereafter, when ready for use, the internal pressure is released and the contents dispensed. A spigot fixed to the container is provided with a pour spout and a vent port, with the pour spout being positioned between the container and the vent port. A slidable closure barrel is mounted to move within the spigot to (a) an inner sealing position wherein the container is sealed, (b) a pressure bleed position wherein only a small pressure release port between the pour spout and the container is opened, and (c) a dispensing position in which the pour spout and vent port are both open. The closure barrel is provided with different arrangements in communication with the vent port that enable air to flow into the container, but prevent outward flow of liquid through the vent port. Interengaging cam means on the closure barrel and spigot cause the closure barrel to move axially when it is rotated, thereby providing precise control of the closure barrel position.

The described arrangement has a number of advantages. It provides a self-contained draft beer package needing no pump or other attachable pressurization device. It also provides a low-cost draft beer filled container and the convenience and safety of substantially atmospheric pressure within the container.

BRIEF DESCRIPTION OF THE DRAWINGS

FIG. 3 is an exploded pictorial view of a spigot embodying principles of the present invention and a neck of a container to which it is to be secured;

FIG. 4 is a pictorial view of the spigot with the closure barrel removed from the spigot body;

FIG. 7 is a section taken on lines 7—7 of FIG. 6;

FIG. 8 is a front view of the pour spout, vent port and pressure release orifice;

FIG. 22 shows the spigot with the float secured to it after assembly of the spigot to the container;

FIG. 23 is a section taken on line 23—23 of FIG. 22 showing the float secured to the spigot;

FIG. 24 is a cross sectional view of the float and closure member illustrating disengagement of the float from the float retaining pin of the spigot; and FIG. 25 shows an alternative structure for temporarily attaching the float to the spigot and spigot base.

DETAILED DESCRIPTION OF THE INVENTION

Figure 1:
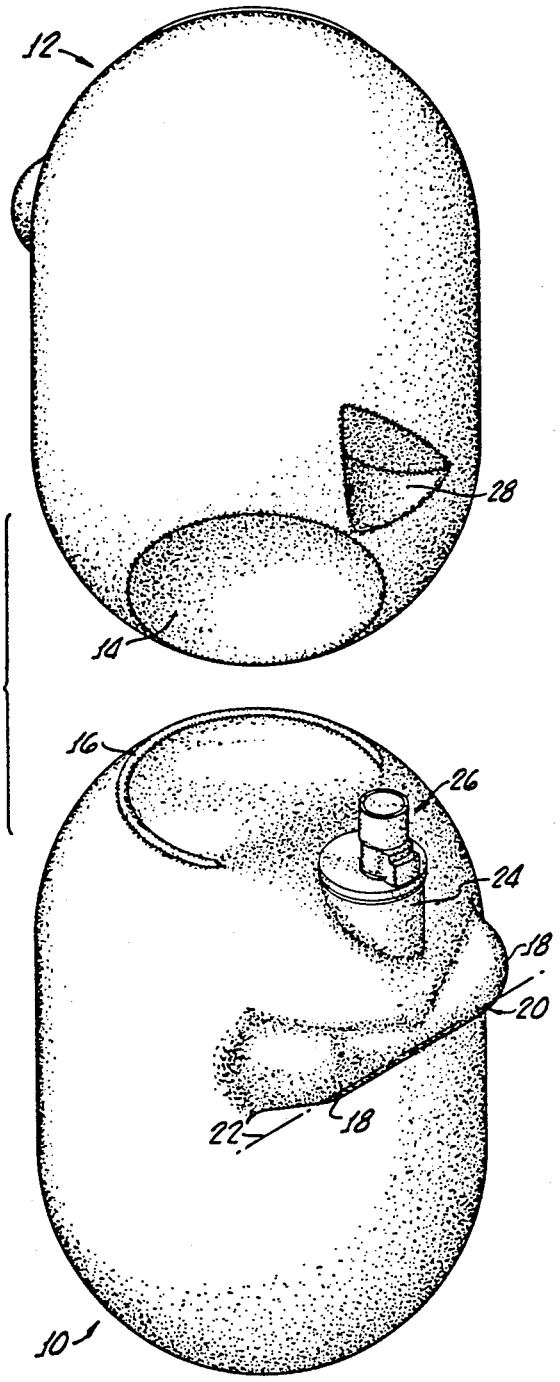
FIG. 1 is a pictorial illustration of a pair of containers embodying principles of the present invention about to be stacked one upon the other.

In accordance with features of the present invention, draft beer, packaged in quantities that may be purchased by an individual consumer, is stored in and dispensed from a container having a volume of one to three gallons. Although containers of such volume are described herein, it will be readily appreciated that principles of the present invention will apply to containers of other sizes. Preferably, such a container, for efficiencies and economies of manufacture and handling, is made of a suitable plastic, such as polyethylene terephthalate (P.E.T.). In packaging draft beer in P.E.T. bottles, just as in bottles made of a number of other plastic materials, consideration must be given to a number of factors such as permeability of the container to the dissolved carbon dioxide, temperature of the filled container, and the amount of agitation of the container during handling and immediately before dispensing.

When a container filled with beer has been allowed to sit quietly for several minutes, the beer exhibits good carbon dioxide retention properties. When the container is sealed with minimal agitation, very little carbon dioxide will migrate from the beer into the head space (e.g., the space within the container above the upper surface of the beer). A significant increase in temperature or considerable agitation is required to stimulate marked migration of carbon dioxide from the beer into the head space.

Water and other beverages do not retain carbonation as well as does beer. It has been found that this carbon dioxide retention feature of beer allows the quiet (without agitation) removal of beer from the package without causing significant loss of carbon dioxide from the beer.

P.E.T. bottles, like many other plastic containers, are permeable to carbon dioxide. In the past this loss of carbon dioxide from the P.E.T. package has caused difficulties. The migration of carbon dioxide through a P.E.T membrane is temperature related, the rate of carbon dioxide loss being much less at lower temperatures than at room temperature. It is believed that the average shelf life loss of carbon dioxide from a draft beer package employing a P.E.T. bottle will not be more than 10% of the initial carbon dioxide content, during shipment and storage of up to 60 days.

In conventional filling operations, such as in the filling of a common metal barrel for draft beer, the barrel is filled from beer tanks at a suitable internal pressure at 30° to 32° F., with the beer having a dissolved carbon dioxide content of about 2.4 to 2.6 volumes (e.g., a volume of dissolved carbon dioxide of 2.4 to 2.6 times the volume of the beer). Such pressure will depend upon the nature of the filling equipment and, in some cases, for example, may be about 14 pounds per square inch.

Generally, after contents of a plastic bottle have been partially dispensed and the bottle is re-sealed and stored, even at 30° to 32° F., the beer will have lost so much of its carbon dioxide content that the remaining beer will no longer be palatable and will be flat tasting.

According to features of the present invention, a plastic bottle of between about one gallon to three gallons or more capacity (as will be more particularly described below) is filled with beer containing an increased volume of carbon dioxide, namely a volume greater than 2.6 and not more than 3.1 times the volume of beer. If the volume of dissolved carbon dioxide is too low, the beer will taste flat. If it is too high, the beer will foam excessively when dispensed. A preferred lower limit is a volume at which the beer is not flat when first dispensed by the consumer, and a preferred upper limit is a volume at which there is no excessive foaming. It is presently preferred that the volume of dissolved carbon dioxide be between 2.9 and 3.0 times the volume of beer. The bottle is filled using standard industry practices to obtain a driving or filling force to achieve a most economical fill. Filling force may vary with different types of fill equipment, and, for example, may be between about 14 and 15 pounds per square inch with some fill equipment. Head space pressure initially is slightly less than fill pressure. This head space pressure of carbon dioxide may vary widely with turbulence and agitation experienced during shipping and handling.

The volume of dissolved carbon dioxide is selectively controlled by standard procedures. In the final holding tank of conventional beer making, volume of dissolved carbon dioxide depends on head pressure and temperature, as set forth in standard charts. To increase volume of dissolved carbon dioxide, the pressure of carbon dioxide in the head space is raised while slowly stirring the beer.

With this increased volume of dissolved carbon dioxide, after a loss of gas through the P.E.T. bottle during a shelf life of about thirty to sixty days, the beer will reach the consumer having a dissolved carbon dioxide content of about 2.7 times the volume of beer. Generally, a shelf life of thirty days is preferable. Therefore, if agitation is kept minimal by the consumer and the beer is maintained at a temperature of about 30° to 32° F., the beer will not be flat when initially opened and poured by the consumer after a normal shelf life. At least partly because of this increased volume of dissolved carbon dioxide, the beer may be readily dispensed with only atmospheric pressure within the container, and, therefore, according to one aspect of the present invention, pressure in the head space of the container is released prior to dispensing. Thus, draft beer, with a good content of dissolved carbon dioxide, may be dispensed without any internal pressurization. Moreover, contents of the bottle may be partially dispensed from the P.E.T. bottle by the consumer and thereafter closed, re-sealed and stored for as much as two or three days at a temperature of about 30° to 32° F. with no significant loss of palatability. After such cold storage for two or three days, the remaining beer will contain a dissolved carbon dioxide volume of about 2.5 times the volume of beer remaining. Thus, even after partial dispensing of the contents and subsequent cold storage for two or three days, the beer will retain a palatable taste and will not be flat, all without the need for any external pressure source.

Figure 2:
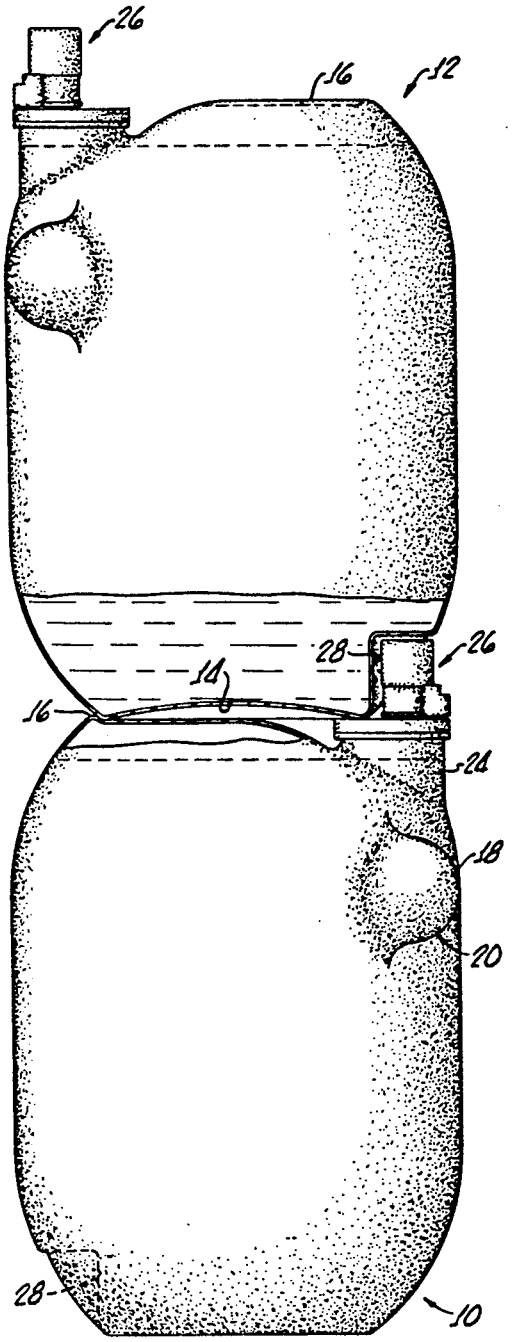
FIG. 2 illustrates the two containers in stacked position.

In an exemplary embodiment of the present invention, a bottle made of plastic, such as 0.015 inch thick P.E.T., is of generally right circular cylindrical shape, as indicated by bottles 10 and 12 in FIGS. 1 and 2, having a decreased diameter, slightly concave or recessed bottom area 14 and an upwardly projecting, partially circumferential rim 16 of a size to snugly receive the bottom of a second bottle for stacking one upon the other, as illustrated in FIG. 2. Each bottle is provided with an integral transverse support leg in the form of an outwardly protruding cross member 18 having a rounded outermost edge 20 of which the center (of the outer surface) extends along an imaginary line 22 that is perpendicular to the bottle axis and tangent to the exterior surface of the bottle. The support edge of leg 20 thus lies in a plane tangent to the exterior surface of the bottle containing an elemental, elongated vertical area or line (in the orientation of FIG. 2) extending along the edge of the bottle. Accordingly, when the bottle is tilted to rest on its side (with its longitudinal axis horizontal) with the support leg 18 horizontal and resting upon a horizontal surface, the bottle will remain in a stable horizontal dispensing position. Although only a single support leg is shown, and only one of the described configuration is necessary, it is contemplated that more than one such support leg may be provided, formed integrally with the bottle, and suitably spaced from one another.

Each bottle is formed with a neck 24 that is offset to one side, that is, to a side that is at the bottom (adjacent the support leg) when the bottle rests on its side for dispensing its contents. To this neck is secured and sealed a spigot 26 which extends upwardly (in the vertical or storage orientation of the bottle illustrated in FIGS. 1 and 2) for a short distance. The lower end of each bottle is formed with an offset recess 28 (on a side diametrically opposite the spigot) that receives the spigot of an adjacent lower bottle when the two are stacked in vertical position (with longitudinal axes of the bottles vertical), as illustrated in FIG. 2. Although an offset recess is illustrated at an opposite side in a preferred embodiment, it will be readily understood that the recess need not be diametrically opposite the spigot, but may be in any one of a number of other positions. The bottles may be stacked three, four, or more high.

As best seen in FIG. 3, the neck 24 of the bottle is provided with a fixed rigid rim 29 secured and sealed thereto to which is fixed and sealed a base 30 of spigot 26. Rim 29 and the spigot base 30 have a relatively large diameter. Spigot base 30 is formed integrally with a hollow, circular, cylindrical spigot body 32 that is provided with a generally rectangular projecting spout section 34 (see FIG. 4) configured to form a vent port 36, a partitioned pour spout 38, and a pressure release port 41. The latter is formed in an innermost (closer to the spigot base 30) wall 39 of the pour spout.

As previously mentioned, the bottle, when used to dispense its contents, is placed on its side so that the axis of the spigot is horizontal and the pour spout, vent passage and pressure relief channel all open downwardly.

Figure 5:
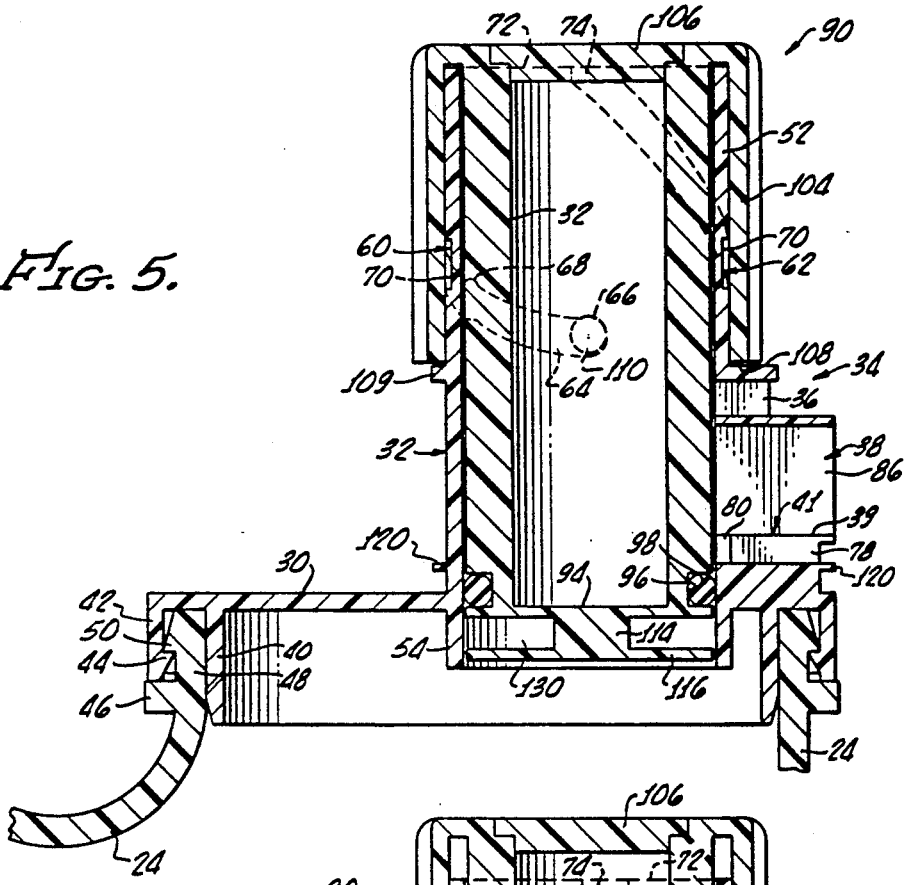
FIG. 5 is a cross section of the spigot in closed position, with the container upright for storage.
Figure 6:
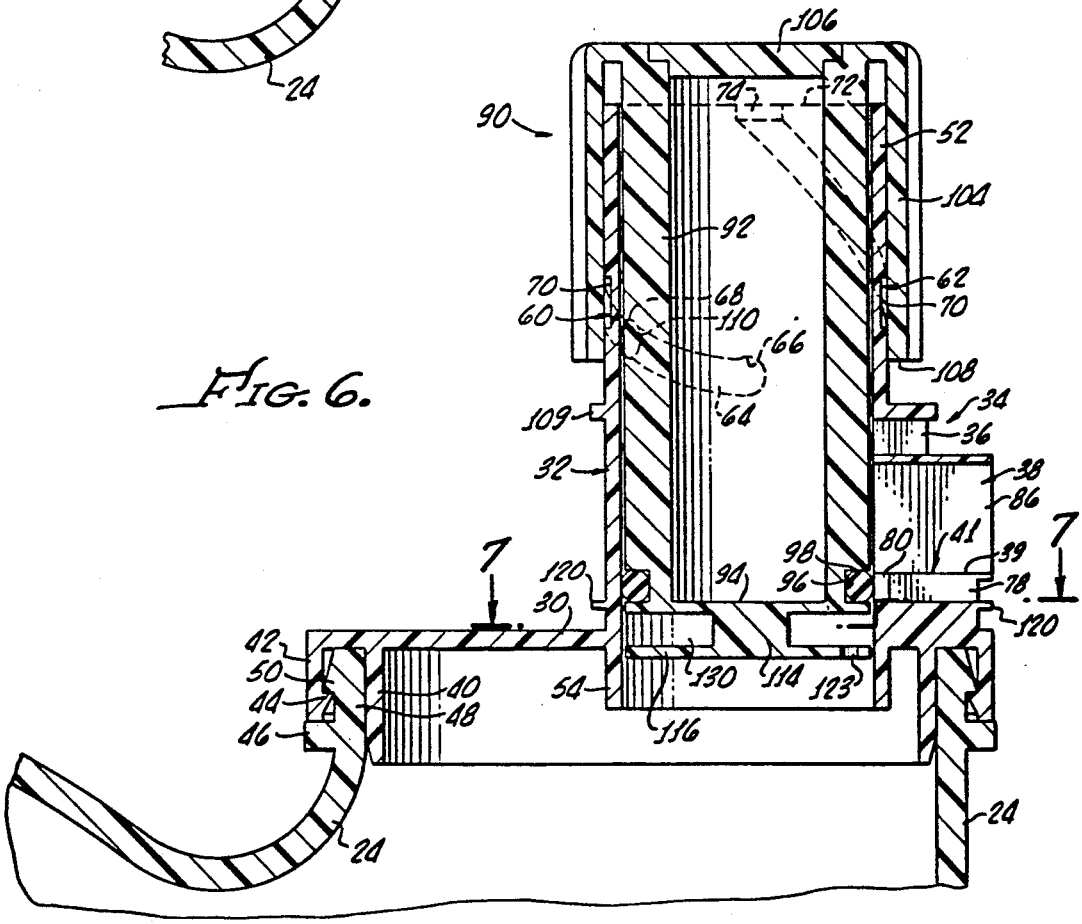
FIG. 6 is a cross section of the spigot in pressure release position, with the container upright.
Figure 9:
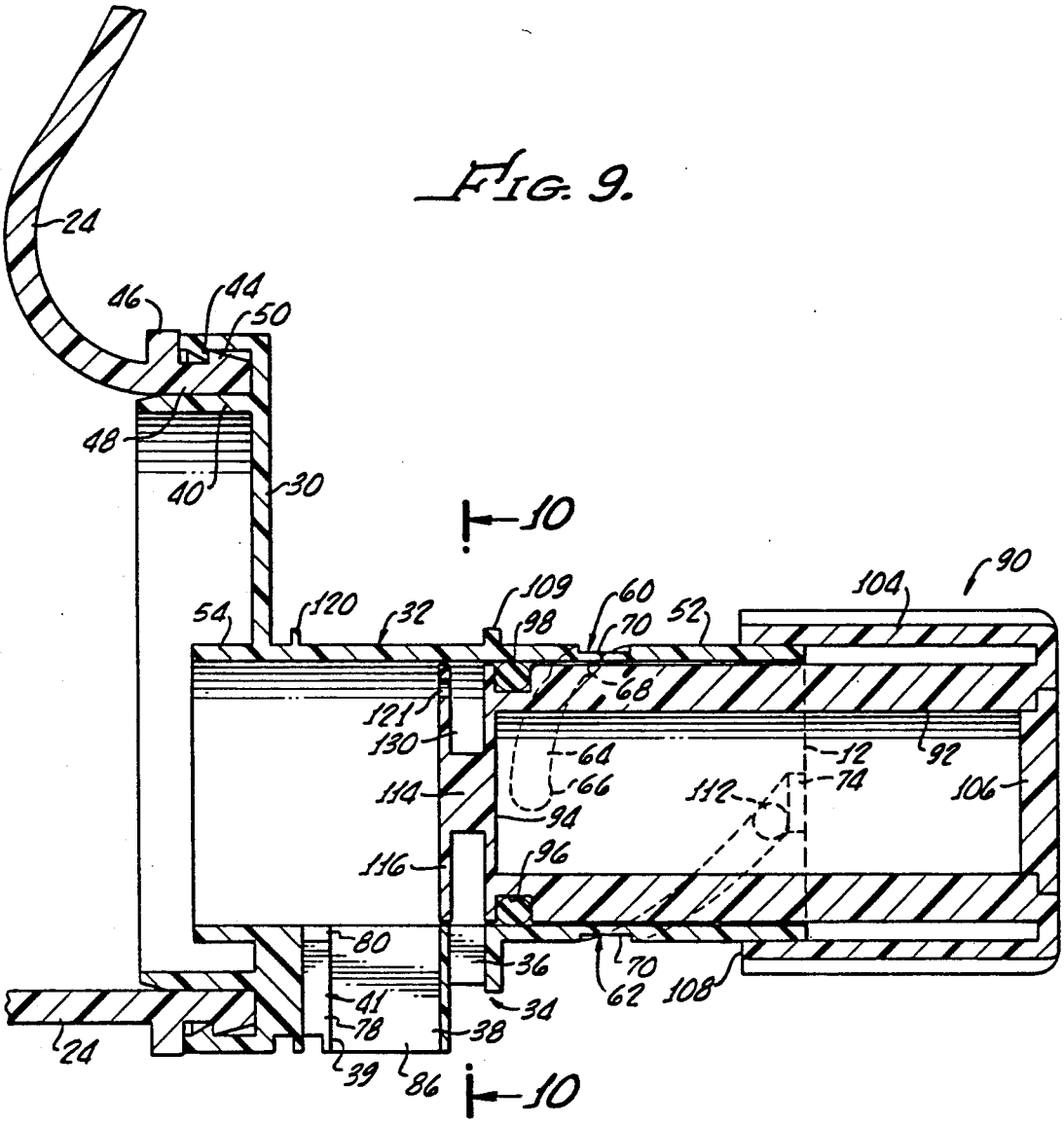
FIG. 9 is a cross section of the spigot in open dispensing position, with the container resting on its side.

As seen in FIGS. 5, 6 and 9, spigot base 30 has a radially inner, axially-projecting circumferential flange 40 concentric with and spaced from an outer, axially-projecting circumferential flange 42, with an axially outwardly facing shoulder 44 formed on flange 42. Bottle neck 24 has a radially outwardly-projecting circumferential flange 46 that abuts an inner end of spigot base flange 42 and includes an integral end section 48 received in the channel between spigot base flanges 40 and 42. A circumferential, radially enlarged head 50 on the outermost end of bottle neck section 48 has an axially inwardly facing shoulder that seats on the shoulder 44 of spigot base flange 42. Surfaces of the end of flange 42 and the end of bottle neck section 48 are inclined to provide a camming action that can expand the annular slot between the spigot flanges 40, 42 as the head 50 enters the slot for assembly. To assemble the spigot to the bottle, the spigot is forced down upon the bottle neck, and an interference fit of the interlocking parts is provided to seal the spigot base to the bottle neck.

In one embodiment, for a bottle made of P.E.T., the spigot and spigot base are made of nylon. The parts are made to precise tolerances and dimensioned so that the outermost end of the bottle neck is a tight force fit into the interfitting elements of the spigot base. For assembly of the spigot to the bottle, the spigot is held in a predetermined orientation with respect to the bottle, which is positioned upright upon a conveyer, and the spigot is forcibly pressed down onto the bottle neck.

The described arrangement physically locks the spigot and its base to the bottle neck, and ensures proper sealing of the bottle, even at pressures greater than normally encountered.

Figure 11:
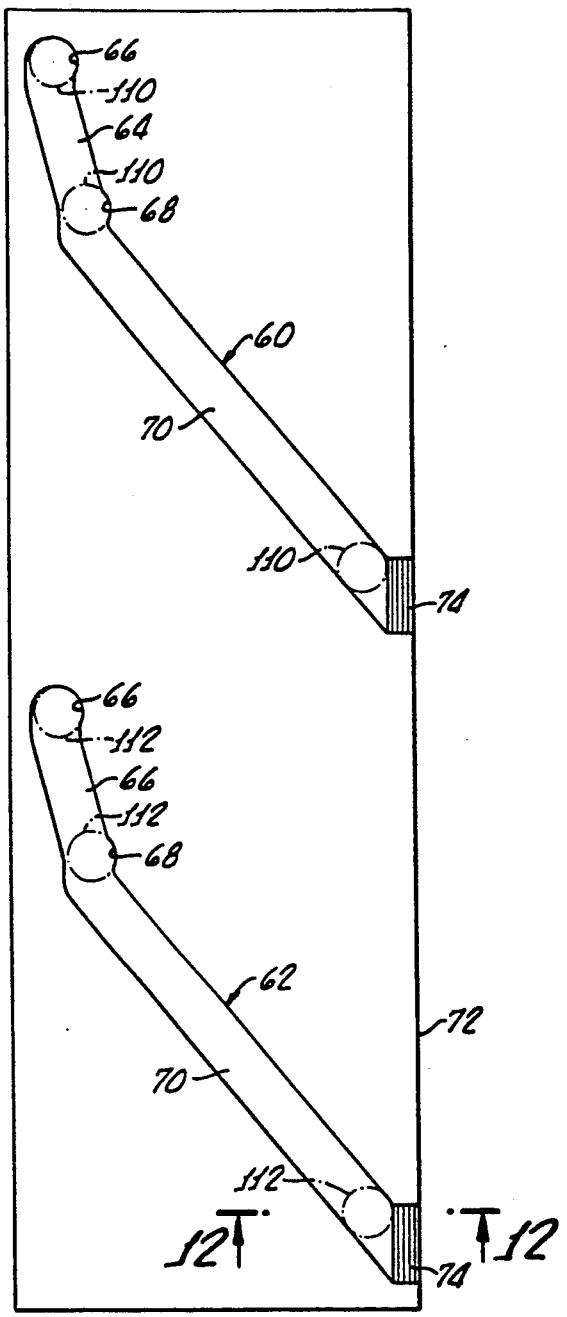
FIG. 11 is a developed view of the exterior surface of the spigot body.
Figure 12:
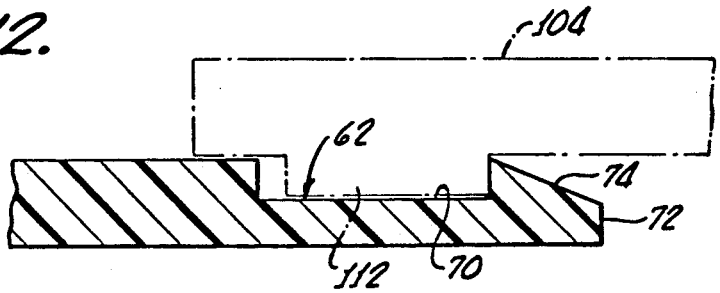
FIG. 12 is a section taken on lines 12—12 of FIG. 11.

Spigot body 32 has an inner end section 54 extending inwardly (downwardly as viewed in FIG. 5) of the spigot base 30. The main section of spigot body 32 extends outwardly as a straight, tubular, circular cylinder (having the generally rectangular, laterally projecting spout section 34) with a smooth inner bore. The outer surface of spigot body 52 is formed with a pair of spiral, closed bottom cam slots 60 and 62 (see FIGS. and 11) that are identical to one another, but circumferentially spaced from each other about the outer surface of the spigot body. FIG. 11 illustrates the spigot body outer surface as developed, that is, as it would look if it were unwound and laid out flat on a viewing surface. The slots are identical, and thus a detailed description of one will suffice to describe both. The slots have closed bottoms, that is, they do not extend through the entire thickness of the spigot body, but form elongated recesses extending only partially into the outer surface of the spigot body. Slot 60 has a relatively short inner leg 64 of relatively small inclination (inclination to a vertical as viewed in FIG. 11), which includes a pair of latching portions in the form of outwardly (toward the right in FIG. 11) displaced sections 66 and 68 positioned at the innermost end and at a slot bend, respectively. At the second latching section 68, the slot bends and assumes a greater inclination to the vertical for a second and longer straight leg 70. Leg 70 extends to the outermost end of the slot. The outermost end of the slot is spaced slightly inwardly of the outermost end 72 (see FIG. 12) of the spigot body, which, for a length equal to about the width of the slot, is tapered, as at 74, to allow a cam pin (to be described more particularly below) to ride over the edge of the spigot body for reception into the slot and assembly of spigot closure barrel 90 to the spigot body. The inner edge of tapered surface 74 defines a shoulder that acts as a stop to prevent withdrawal of the closure barrel member, to be described below.

As previously mentioned, the spigot body is formed with a generally rectangular, downwardly (in the dispensing orientation of FIG. 9) projecting pour spout 38 having a relatively thick inner wall 39 in which is formed a pressure relief port 41. This port is defined by a channel 78 opening into pour spout 38 see FIGS. 7 and 8 . Channel 78 has a relatively large width for a major portion of its length, as best seen in FIG. 7, and at an end where the channel connects with the interior bore of the spigot body, its width is reduced, as indicated at 80. This pressure relief port provides a restricted gas communication passage from the interior bore of the spigot body to the exterior of the spigot.

Pour spout 38 is formed with a plurality of spaced partitions 84, 86 which divide the total spout area into three smaller areas for purposes to be described below.

Outwardly of the pour spout 38, in the dispensing section 34 of the spigot, is the slightly stepped back and smaller vent port 36, of generally rectangular configuration, but of smaller extent in the longitudinal direction of the spigot body. Vent port 36 also provides communication between the interior of the spigot body and external atmosphere.

The spigot body is fitted with closure barrel member 90 having a hollow tubular barrel body 92 integrally formed with a sealing inner end portion 94 at which end portion is formed a peripheral annular groove 96 seating a resilient O-ring 98. Although the described O-ring and groove provide simple and effective sealing arrangement, it is contemplated that they may be replaced by continuous circumferential ribs formed integrally on the exterior surface of the closure barrel body and having a slidable sealing fit within the spigot body bore. The rib has a profile that forms a part of a circle so that the profile of the integral rib and barrel body is thus the same as the profile of barrel body and O-ring. This construction will further decrease cost of manufacture and assembly. The closure barrel is movable to a selected one of three positions as follows: (a) a position in which the entire spigot bore is closed; (b) a position in which only the dispensing spout and vent port are closed (leaving the pressure relief port open); and (c) a position in which all of the dispensing section passages are open. The exterior surface of barrel body 92 is a close rotating and sliding fit within the smooth bore of the spigot body and has fixedly connected thereto at its outer end an integral knurled barrel sleeve 104 that is concentric with the barrel body and outwardly spaced therefrom to provide an annular space between the sleeve and barrel body for reception of the spigot body 32. The outer end of the hollow barrel body is closed by a disc 106 that is fixedly secured to the barrel body.

On diametrically opposed sides of the inner end 108 of the barrel sleeve 104 are fixed short cam pins 110, 112 projecting radially inwardly for a distance substantially equal to the depth of the cam slots 60 and 62. Pin 112 is positioned precisely 180° around the sleeve 104, relative to pin 110, and at the same longitudinal position with respect to the innermost end of the sleeve. Pins 110 and 112 are received in cam slots 60 and 62, respectively. The barrel member 90 is assembled to the spigot body by pressing it longitudinally on the outer end of the spigot body to cause both cam pins 110, 112 to ride up over tapers 74 into the cam slots. The assembled spigot arrangement is such that rotation of the closure barrel member by grasping the outwardly knurled surface of sleeve 104, causes the cam pins to move along the slots, thereby axially shifting the closure barrel member relative to the spigot bore.

The innermost side (lower side as viewed in FIG. 5) of the inner end 94 of the closure barrel member has an axially inwardly projecting hub 114 that terminates in a vent disc 116, which has a diameter substantially equal to or slightly less than the diameter of the spigot body bore. The diameter of disc 116 is equal to the outer diameter of the barrel body 92, and both are a close sliding fit in the spigot body bore. The spigot and barrel body closure barrel member, being molded of low friction nylon or other plastic materials, allow ready manually-manipulatable sliding and rotary motion of the closure barrel with respect to the spigot body, while providing a sufficiently close fit to block fluid flow between the sliding surfaces. It will be understood, of course, that the primary sealing of the spigot body bore by the closure barrel member is accomplished by the O-ring 98, which is captured in the barrel body slot, and which has a tight, sliding, sealing fit within the spigot body bore.

Figure 10:
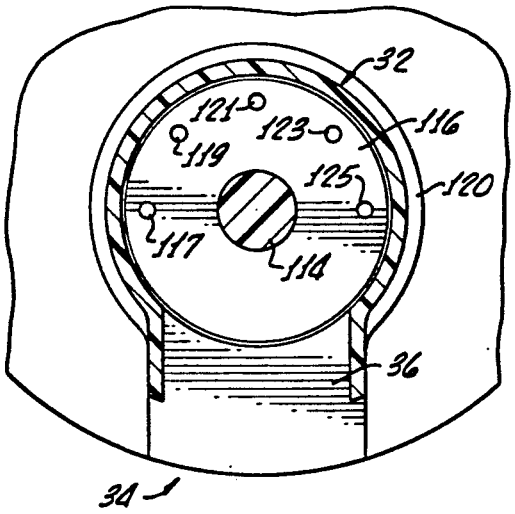
FIG. 10 is a section taken on lines 10—10 of FIG. 9.

Vent disc 116, as can be best seen in FIGS. 7 and 10, is provided with a series of mutually-spaced, circumferentially distributed small holes 117, 119, 121, 123, 125, each of Which is less than an eighth of an inch in diameter. Preferably, the holes are approximately one-sixteenth of an inch in diameter. These holes are provided in such a small size to enable surface tension of the confined liquid to prevent flow of liquid through these holes when there is substantially no pressure difference across the disc. The holes do allow flow of air into the container, as will be described more particularly below.

The bottle, such as bottle 10 or 12, is force-filled at an appropriate pressure with a quantity of beer containing dissolved carbon dioxide having a volume of between 2.6 to 3.1 times the volume of beer contained therein. The beer, at all times during handling and shelf life, will retain this increased volume of carbon dioxide, except for loss of that portion of the dissolved gas that migrates from the beer through the bottle wall. However, in the handling and storage of the bottle, before it is used by the consumer, the internal pressure within the head space remains to assist in retaining the carbon dioxide in solution. This pressure, as previously mentioned, will vary with agitation experienced during shipping and handling. Only when the beer is ready to be dispensed is this internal pressure released and the head space pressure allowed to go down to atmospheric pressure. In handling and storage of the filled container, it is positioned upright or vertical, as shown in FIGS. 1 and 2, and several containers may be vertically stacked one upon the other in such vertical position. The exterior of the spigot body 52 is formed with a projecting rib 120 (FIG. 4) that circumscribes the spigot and provides a circumferential lip for holding an inner edge of a shrink wrap spigot cover, shown in FIG. 3, which encompasses and seals the entire spigot and openings therein.

Initially, after filling the container, the closure barrel member is twisted in a clockwise direction, as viewed from the outer end of the spigot, to axially shift the closure barrel member to its innermost or bottle sealing position. In this bottle sealing position, the cam pins are received in the innermost ends of slots 60 and 62, and, more specifically, in the enlarged latching portion 66 thereof. To move the closure barrel from this closed sealed position, the barrel must be pressed inwardly and then rotated in a counterclockwise direction to enable the pins to ride out of the latching notches 66 at the inner ends of the cam slots.

In the closed innermost position illustrated in FIG. 5 (wherein the cam pins 110, 112 are positioned in the innermost ends of the cam slots), the inner sealing end 94 of the barrel body, and, in particular, the sealing O-ring 98 thereof, is positioned within the spigot body bore inwardly of the innermost portion of pressure relief port 41. Thus, the bottle is completely sealed by the closure barrel O-ring. The barrel is held in its closed position by the cam slot latching recesses 66 and internal pressure of the container. Internal bottle pressure tends to drive the closure barrel 92 axially outwardly, and thus further into the latching recesses 66, so that rotation of the barrel body is restrained.

Before dispensing beer from the sealed and pressurized bottle, it is necessary to remove the shrink wrap and to bleed pressure from the head space of the bottle so that the bottle interior is at substantially atmospheric pressure. Pressure release is accomplished with the bottle upright, by pressing axially inwardly on the barrel sleeve 104 to tend to move the cam pins out of the closure latching slots 66 and, at the same time, turning the barrel sleeve in a counterclockwise direction. The barrel sleeve turns and the cam pins ride outwardly along the lesser inclination cam slot legs 66 until the pins are received in the pressure release latching recesses 68. This lesser inclination yields more precise control of axial position of the barrel, because greater rotation results in smaller axial motion of the barrel body. The latching recesses 68 provide a kind of detent action which can be felt by the operator and which will tend to resist any further rotation of the barrel sleeve relative to the spigot. When the cam pins have reached the latching recesses 68, the closure barrel has traveled axially from the position of FIG. 5 to that illustrated in FIG. 6. If the closure barrel should accidentally be moved past the pressure release position before internal pressure is fully released, the high internal pressure tends to force the O-ring 98 from its seal. Partitions 84, 86 of the pour spout help to retain the O-ring on its seat.

In the pressure release position of FIG. 6, the sealing O-ring 98 is at a lower or innermost portion of the pour spout 38 and just outwardly of (above, as seen in FIG. 6) the inner end of the pressure release channel 41. The O-ring in this position partially blocks release port 41, thereby decreasing, even further, the effective area of the small channel section 80, and providing a very small relief orifice. With the bottle in vertical position, the release port 41 is above the upper surface of beer confined in the bottle and may therefore release pressurized gas from the head space. Pressurized gas from the bottle head space can now flow through the vent apertures 117 through 125 and out through the pressure release port 41, flowing through the very small port of release channel section 80 that is not blocked by the O-ring. Accordingly, in the pressure release position of FIG. 6, pressurized gas at the top of the still vertical bottle is released slowly through the restricted relief port until the pressure within the container is substantially equal to atmospheric pressure. This may require but a few seconds. Now the container is ready for dispensing of beer.

While the bottle is sealed, with the closure barrel member in the closed position of FIG. 5, beer is forced through the vent holes 117, 119, etc., into the annular space 130, surrounding hub 114 between the vent disc 116 and the barrel inner end 94. When the closure barrel has been moved to the pressure release position of FIG. 6, the small amount of beer in the space 130 is slowly vented through the very small release aperture 41, and the pressurized gas within the head space of the bottle is also vented. It is important that the space 130 between the vent disc 116 and the inner end 9 of the closure barrel be sufficiently large to keep surface tension from blocking flow of beer through this space 130. Beer within the space 130 will readily flow outwardly from the space 130 through the pressure release port when the closure barrel member is in its pressure release position of FIG. 6, or may drip from space 130 when the spigot is moved toward the dispensing position. However, only a small amount of beer from the interior of the container, together with the pressurized gas from the head space, will be forced by head space pressure outwardly through the vent holes, through the space 130, and then through the pressure release port 41.

After having relieved the pressure from the interior of the bottle, the spigot may be re-closed to seal the bottle contents. The bottle then is placed on its side with the transverse support leg 18 resting upon a horizontal surface, and the knurled sleeve again is rotated toward open position. To open the spigot for dispensing beer, the barrel sleeve 104 is further rotated in a counterclockwise direction, thereby forcing the cam pins to ride out of the latching notches 68 and to ride along the more steeply inclined longer slot legs 70. The closure barrel member thus moves axially along the spigot as it is rotated and attains its final or open position, as illustrated in FIG. 9. The steeper inclination of cam slot legs 70 cause a greater axial motion for a given amount of rotation, and provides faster opening In the open position, the O-ring 98 has moved to a point just at or outwardly of the outermost side of the vent port 36, and the vent disc 116 is now positioned just inwardly of the inner end of the vent port 36 but just outwardly of the outermost side of the dispensing or pouring spout 38. The vent disc, as previously mentioned, is a close but sliding fit within the bore of the spigot body and is a close enough fit to block flow of beer past the disc along the walls of the spigot bore (after release of head space pressure). In this position, the liquid content of the bottle will flow under the force of gravity through the spigot bore, which is now at the lowermost portion of the bottle, and thence from the bore through the dispensing port 38. Because the internal pressure within the bottle has been relieved, there is substantially no pressure difference across the apertures of the vent disc, and thus surface tension of beer within the container and within the bore, but inwardly of the vent disc, will prevent flow of beer through the vent apertures. However, ambient air can flow in through the vent port, through the space 130, and thence through the several vent apertures 117, 119, etc., bubbling up through the beer to the upper surface, thereby breaking any vacuum that may tend to form within the bottle as the beer flows outwardly through the dispensing spout 38.

A small amount of pressure may build up within the bottle during storage after dispensing part of its contents. Therefore, whenever the closed bottle is to be opened for dispensing beer after a period of storage, it should be depressurized again by moving the spigot closure barrel to pressure relief position with the bottle upright.

Figure 13:
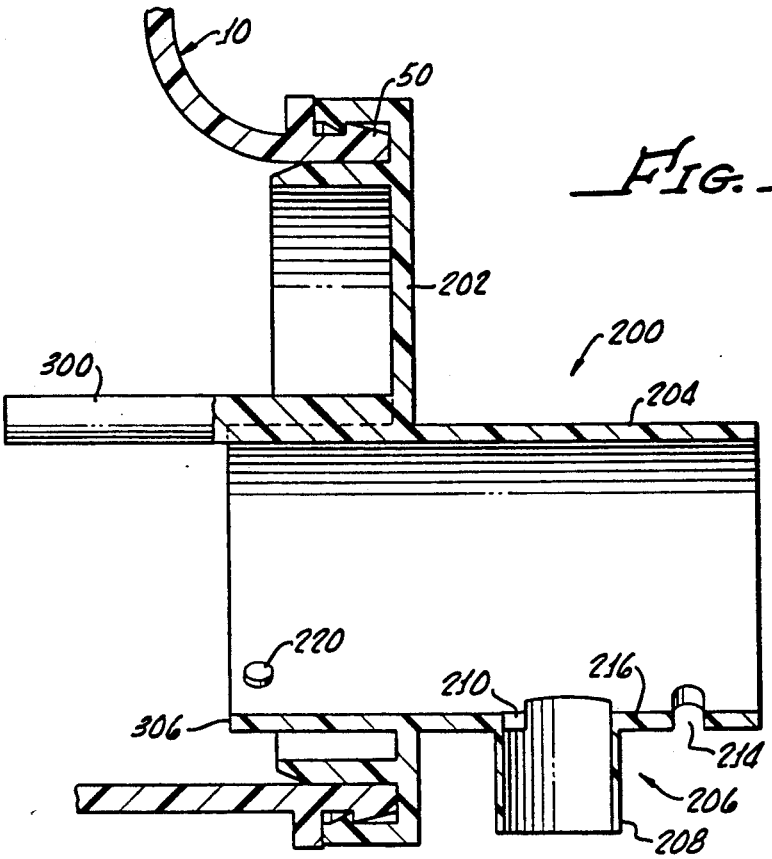
FIG. 13 is a cross section of a modified form of spigot.

Illustrated in FIGS. 13 through 20 is a container with a modified spigot enclosure. The embodiment of FIGS. 13 through 20 is functionally and operationally similar to that of FIGS. 1 through 12, in that it will be filled substantially in the same manner as the prior embodiment is filled and under the same conditions. It also may be handled, stored, and used for dispensing just as is described in connection with the earlier embodiment. One significant difference between the two embodiments is the fact that the embodiment of FIG. 13 need not be placed in an upright position in order to release the pressure confined within the bottle. In the embodiment of FIG. 13 both of the operations of pressure relief and dispensing of contents may be carried out with the bottle on its side and the pour spout facing downwardly. The bottle may be reclosed in such position, where it may remain until more of its contents is to be dispensed. To enable pressure relief in the horizontal position of the bottle, with the spigot protruding from a lower portion of the side of the bottle (and the bottle is on its side for dispensing), the inner portion of the closure barrel is modified, and a vent tube is connected to the closure barrel to extend upwardly to a buoyant end of the vent tube that always remains at the upper surface of the liquid contents of the container.

Figure 14:
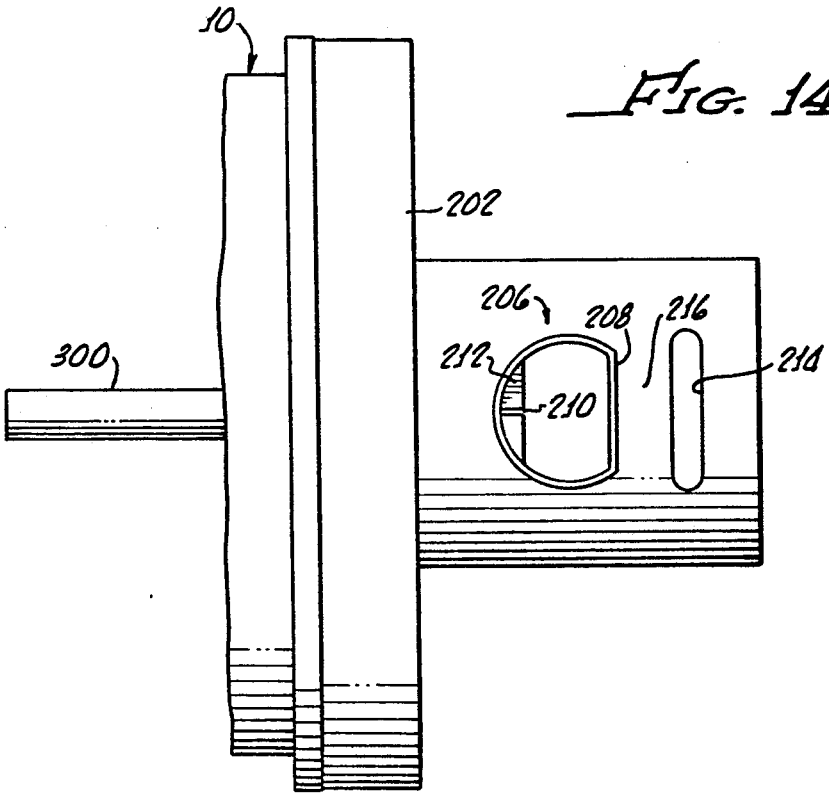
FIG. 14 is a view of the bottom of the spigot of FIG. 13.
Figure 15:
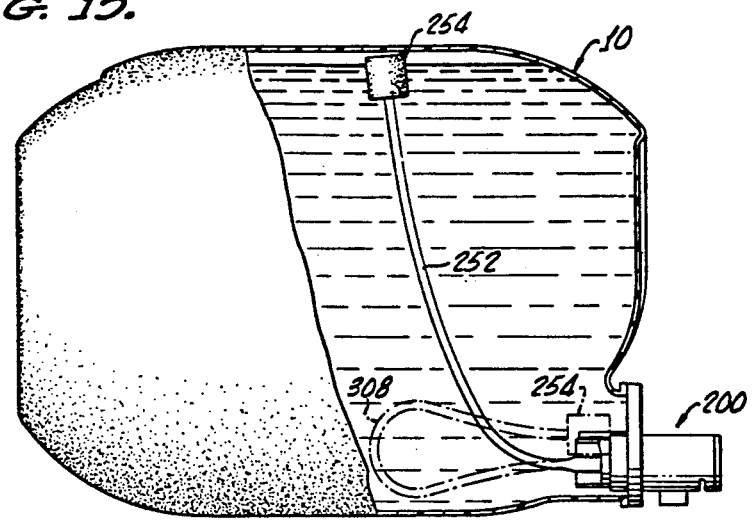
FIG. 15 is an illustration of a bottle with parts broken away showing a vent tube in the bottle connected through the spigot.

As illustrated in FIG. 13, spigot 200 of the modified embodiment includes a spigot base 202 which may be substantially identical to base 30 of the earlier embodiment, and connected to a bottle 10, as previously described. The spigot is formed integrally with a hollow, right circular, cylindrical spigot body 204 that is provided with a projecting spout section 206 configured to form a pour opening in the form of a spout 208 and a pressure release port 210. The latter is formed in an innermost (closer to the spigot base 202) wall 212 of the pour spout 208. The pour spout 208 has a truncated circular cross section, as shown in FIG. 14, with the wall 212 extending across an inner portion thereof and defining the very small centrally located pressure release port 210 at a midpoint of the wall. Positioned outwardly of the pour spout 206, in substantial longitudinal alignment therewith, is a circumferentially extending vent port 214 that is spaced outwardly of the pour spout 206 by an intervening wall portion 216 of the spigot body 204. The vent port 214 has a lesser extent axially of the spigot than does the pour spout, although it has substantially the same circumferential extent.

In the arrangement of FIGS. 13 through 20 the bottle is at all times, except perhaps during handling and storage, positioned on its side so that the spigot is at a lower part of the container, the axis of the spigot is horizontal, and the pour spout, vent port, and pressure relief port all open downwardly.

Figure 19:
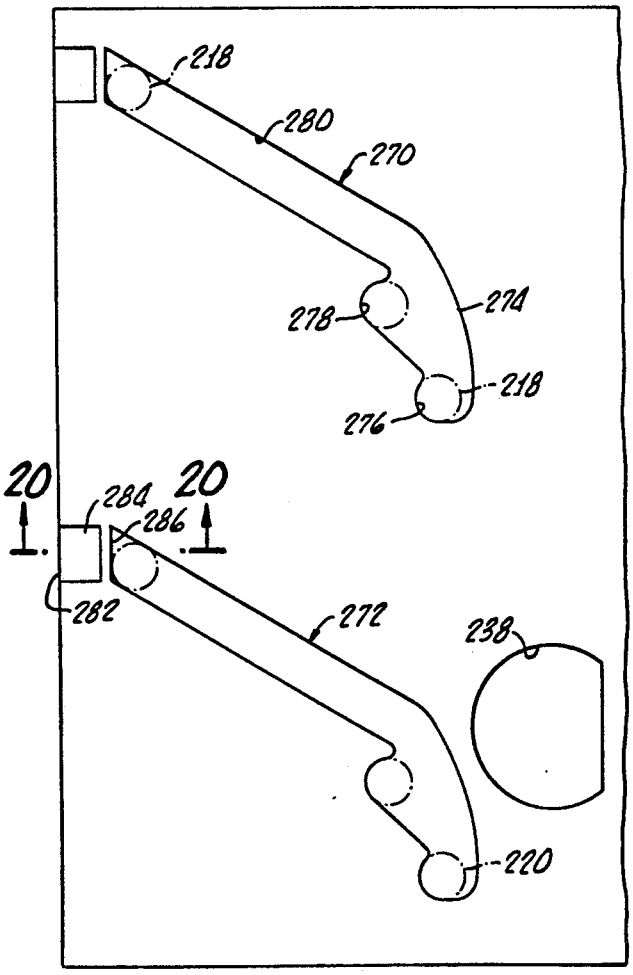
FIG. 19 is developed view of the exterior surface of the closure barrel.
Figure 20:
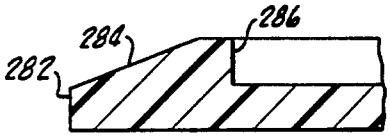
FIG. 20 is a section taken on lines 20—20 of FIG. 19.
Figure 21:
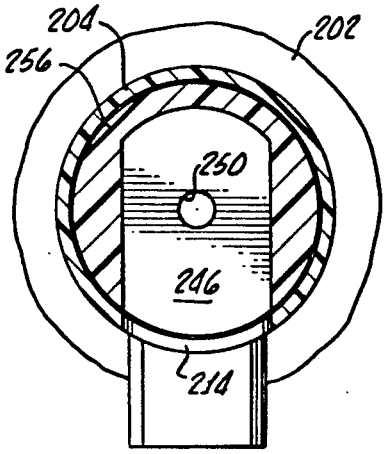
FIG. 21 is a section taken on lines 21—21 of FIG. 18.

The spigot has a pair of diametrically opposed short cam pins 218,220, projecting radially inwardly thereof for cooperation with spiral cam slots formed in the closure barrel. The pins 218,220 and the cam slots are illustrated in FIG. 19, which will be described more particularly below.

Just as in the prior embodiment, the spigot body is fitted with a slidable closure barrel member 230 (FIGS. 16, 17 and 18), having a hollow tubular barrel body or cylindrical section 232 that is open at an inner end 234, in fluid communication with the interior of the container, and integrally formed with a thick sealing wall 236 intermediate its length. A pour opening 238 extends through the tubular wall 232 and has a truncated circular configuration congruent with the truncated circular configuration of the pour spout. The flat outer side of the truncated opening 238 is substantially aligned with the inner edge 240 of the sealing wall 236.

Formed in the sealing wall 236, outwardly of the pour opening 238 and longitudinally aligned therewith, is a vent opening 244 that opens to the bottom of the spigot (when the spigot is in dispensing position). Opening 244 connects with a chamber 246 that extends inwardly from the opening 244 over a major portion of the cross sectional area of the sealing wall, as illustrated in FIGS. 16, 17, 18 and 21. Integrally formed with sealing wall 236 and extending axially of the cylindrical section 232 to the open end 234 thereof is a relatively small diameter vent tube 248 that communicates, via a passage 250 formed in wall 236, with vent chamber 246 and vent opening 244. A flexible, thin wall vent tube 252 (see also FIG. 15) is connected at one end to the free end of vent tube 248, and extends inwardly through the container to an area adjacent the upper portion of the container interior to enable release of pressure from the container head space prior to dispensing fluid and to enable venting of air into the container during dispensing. A buoyant member, such as a float 254, is secured to the inner end of vent tube 252 to maintain the free end of the tube in the container head space. This arrangement facilitates release of container head space pressure while the container is on its side.

The body of the closure barrel extends outwardly beyond sealing wall 236, to include integral outer body section 256, to an outermost end portion having a radially outwardly projecting handle 258. The handle is employed to facilitate manual turning of the barrel closure member as is required for operating the dispensing spigot.

Formed in the exterior of the closure barrel, respectively inwardly and outwardly of the vent opening 244 and vent chamber 246, are circumferentially extending inner and outer O-ring grooves 260 and 262, which receive O-rings 264,266 respectively. The O-rings form a liquid and gas seal between the exterior of the closure barrel and the smooth interior bore of the spigot body 204. If deemed necessary or desirable, the outer end portion of the barrel closure body 256 may be formed with a plurality of apertures of suitable dimensions and configuration in order to decrease material and weight of the spigot.

The closure barrel of FIGS. 13 through 21, like the closure barrel of the earlier described embodiment, is movable to a selected one of three positions as follows: (a) a position in which the entire spigot bore is closed; (b) a position in which only the dispensing spout and vent port are closed (leaving the pressure relief port open); and, (c) a position in which all of the dispensing section passages are open. The exterior surface of the barrel body 232 is a close rotating and sliding fit within the smooth bore of the spigot body and has formed therein a pair of outwardly opening spiral, closed bottom cam slots 270,272, which are illustrated in detail in developed form in FIG. 19. The two cam slots are identical to one another, but circumferentially spaced from each other about the outer surface of the closure barrel body. The slots are substantially similar to the slots 60,62 illustrated in FIG. 11, but are formed on the exterior of the slidable closure member in the embodiment of FIGS. 13 through 21, whereas the slots of the earlier described embodiment are formed in the exterior of the spigot body.

Slot 270 has a relatively short inner leg 274, of relatively small inclination to the vertical, as viewed in FIG. 19, and includes a pair of latching portions in the form of notches or laterally outwardly displaced sections 276,278 positioned at an outer end and at a slot bend respectively. The slot bends at the second latching section 278 and assumes a greater inclination to the vertical for a second and longer straight leg 280. Leg 280 extends to the inner end of the slot, which is spaced slightly outwardly of the innermost end 282 of the closure barrel member. The end of the closure barrel is tapered, as indicated at 284 (FIG. 20), to allow cam pins 218,220 to ride over the end of the barrel member into the slots when the barrel member is inserted into the spigot bore. This tapered end portion 282,284 also provides a stop shoulder 286 that prevents the complete withdrawal of the barrel closure member from the spigot bore. Shoulder 286 forms a limit stop that abuts the pin 218 when the barrel closure has moved to its outermost or liquid dispensing position.

Figure 16:
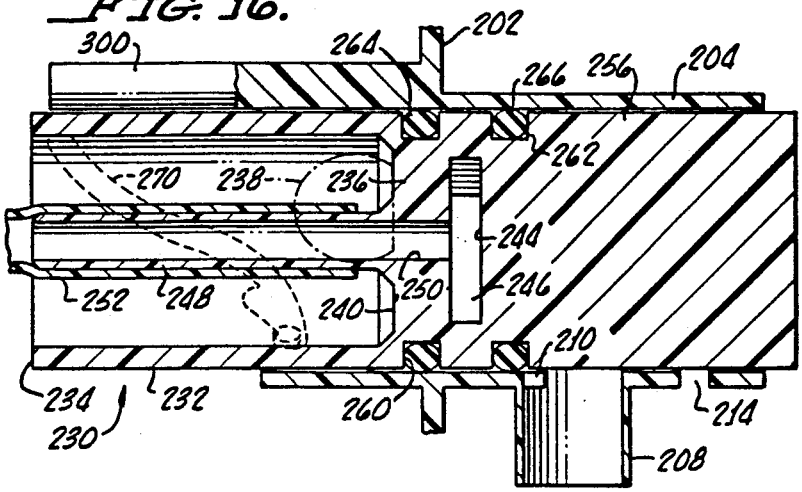
FIGS. 16, 17 and 18 are cross sections of the spigot and closure barrel in three different positions.

Just like the earlier embodiment, after filling the container, the closure barrel member is twisted in a clockwise direction, as viewed from the outer end of the spigot, to axially shift the closure barrel member inwardly to its innermost or bottle sealing position. The cam and cam slot arrangement cause this relative axial motion in response to rotation of the closure barrel member. In this bottle sealing position, which is illustrated in FIG. 16, the cam pins 218,220 are received in the outermost ends of slots 270,272 and, more specifically, in the enlarged latching portion 276 thereof. To move the closure barrel from this closed, sealed position, the barrel may be pressed inwardly, and then rotated in a counterclockwise direction to enable the pins to ride out of the latching notches 276 at the ends of the ca slots.

In the closed position illustrated in FIG. 16, both of the sealing O-rings 264,266 are positioned inwardly of the spout section, inwardly of both spout 208 and vent port 210. Thus the interior of the container is completely sealed by both of the O-rings. The closure barrel is held in its closed position by the cam slot latching notches 276 and the internal pressure of the container. Internal pressure, just as in the earlier described embodiment, tends to drive the closure barrel 204 axially outwardly, and thus tends to drive cam pins 218,220 further into the latching recesses 276, so that rotation and longitudinal shifting of the barrel body is restrained.

Before dispensing beer from the sealed and pressurized bottle, it is necessary to bleed pressure from the head space of the bottle, so that the bottle interior is at substantially atmospheric pressure. Such venting is accomplished with the bottle horizontal, in its dispensing position, by pressing axially inwardly on the barrel sleeve 204 at the handle end thereof to urge the cam pins out of the closure latching notches 276, and at the same time turning the closure barrel member in a counterclockwise direction. The closure barrel turns and moves axially outwardly, and the cam pins ride along the lesser inclination cam slot legs, propelled axially in part by the manual rotation and in part by the internal pressure of the container. This motion of the closure barrel brings the cam pins into the deeper pressure release latching notches 278. In this position the latching action of the notches 278 resists further rotation and axial motion of the barrel closure member. The outward axial force of the internal pressure of the container acts only to urge the notches 278 to more firmly latch the cam pins. When the cam pins have reached the latching notches 278, the closure barrel member has traveled axially outwardly and has been rotated from the position of FIG. 16 to the position of FIG. 17. This is the pressure release position.

Figure 17:
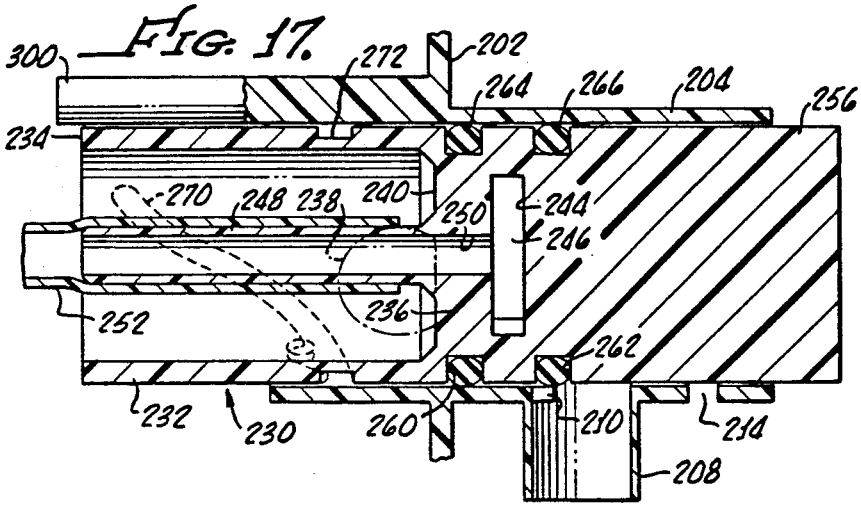

In the pressure release position of FIG. 17, sealing O-ring 264 is still positioned significantly inwardly of the pour spout and vent port. However, the outer O-ring 266 is positioned at an innermost portion of the pour spout just outwardly of the inner end of wall 212 and pressure release channel 210. Moreover, the axial rotational shifting of the closure barrel member has moved the closure barrel vent opening 244 and chamber 246 to a position at or nearly at the axial position of the pressure release port 210. Additionally, the rotation of the barrel closure member has rotated the vent opening 244 until at least one edge of it is in registration or almost in registration circumferentially with the pressure release port.

In the closed position of FIG. 16, the spout or pour opening 238 of the barrel closure member is substantially longitudinally aligned with the vent opening 244, and both of these are circumferentially displaced from the pour spout 208. The vent opening need not be aligned with the pour opening of the closure barrel as long as it is in registry with the vent port 214 in dispensing position and is positioned in the pressure release position so as to permit gas flow from the vent opening to the pressure release channel 210.

The combined longitudinal and rotational shifting of the barrel closure member from the closed position of FIG. 16 to the pressure release position of FIG. 17 shifts the vent opening 244 longitudinally and also rotates it toward alignment with pressure release port 210, to a position wherein an edge of vent opening 244 is close to an edge of the pressure release port. Precise circumferential and longitudinal alignment of vent opening 244 with release port 210 is not required, since the two sealing O-rings are on outer and inner sides of the release port 210 and vent opening 244. Even without alignment of the vent opening with the release port, a very small passage for air is provided from the vent opening 244 to the pressure release port 210 between the smooth interior of the spigot body and the smooth exterior of the sealing wall 236 between the two O-rings. Thus, when the pins reach the latching notches 278, the barrel closure member has reached the position shown in FIG. 17 in which a very small gas release passage is provided from the vent opening 244 (and, therefore, from the container head space) to the vent port 210. Flow of liquid through the pour spout 208 from the container in pressure release position is blocked by both of the O-rings, both of which are positioned outwardly of pour opening 238 of the barrel closure member. Thus, gas under pressure, confined within the head space of the bottle in its horizontal dispensing position, will escape through the vent tube 252, entering the free end of the tube at the portion of the tube adjacent the float 254 and flowing through the tube, through conduit 248 of the closure barrel, and through the chamber 246, vent opening 244 and vent port 210.

Figure 18:
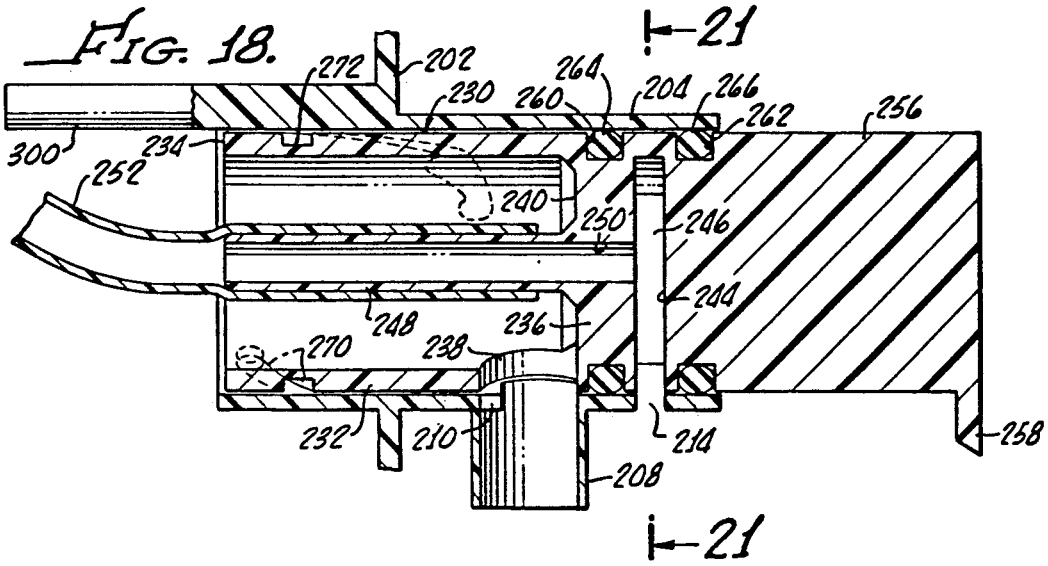

With the closure barrel member in the pressure release position of FIG. 17, all pressure is released from the interior of the container within a few seconds, and the closure barrel member then may be moved further outwardly to the outer dispensing position, which is illustrated in FIG. 18. When in the pressure release position, and after internal pressure has been released, there is no pressure tending to drive the cam pins 218,220 further into the latching notches 278, and thus the barrel member may be rotated easily to move the cam pins out of the latching notches and along the outer legs 280 of the cam slots. To move the pins out of notches 278, the barrel closure is pressed inwardly and simultaneously rotated counterclockwise. The steeper inclination of these cam slot legs provides a relatively greater axial shifting for a given amount of rotation, and the closure barrel member is readily moved to the outer dispensing position illustrated in FIG. 18. In moving to this position both the pour opening 238 and the vent opening 246 of the barrel closure member move both axially and circumferentially to a position wherein each is registered respectively with the pour spout and the vent port 214. In the open position, O-rings 264,266, are still on inner and outer sides respectively of the vent opening 244 of the closure barrel, and now also are on inner and outer sides respectively of the vent port 214 of the spigot body. As can be seen in FIG. 18, O-ring 264 is now positioned between the vent port and the pour spout, and thus liquid being dispensed from the container through the pour spout 208 is blocked from passing between the interior of the spigot bore and the exterior of the closure barrel by the presence of the O-ring 264. In the pouring position of FIG. 18 the truncated circular pour opening 238 is precisely registered with the similarly shaped pour spout 208, and thus liquid will flow from the interior of the container through the hollow spigot, through the cylindrical portion of the closure barrel, and out through the pour spout of the spigot. At the same time air is allowed to flow into the container through the vent port 214, vent opening 244, vent tube 248 and conduit 252 to replace the volume of liquid that is dispensed. In this position the contents of the container are dispensed under the force of gravity and the spigot and its opening are positioned at the bottom of the container (which is on its side during pouring and pressure release operations, as previously described.

After the desired amount of the bottle contents has been dispensed, the bottle may be closed and resealed simply by rotating the closure barrel in the opposite direction to cause it to move axially inwardly past the pressure release position of FIG. 17 to the closed and sealed position of FIG. 16. If some small amount of pressure should build up within the bottle during storage, after dispensing part of its contents, the closed bottle may be depressurized again by initially moving the spigot closure barrel to its pressure relief position and letting it stay there for a few seconds before moving the closure barrel to the dispensing position.

The closure barrel of FIGS. 13 through 21 is longer than that of the first embodiment, incorporating the inner cylindrical section 232. This provides increased stabilization and rigidity of interconnection between the barrel closure member and spigot, particularly in the outer dispensing position.

As described above and illustrated in solid lines in FIG. 15, the vent tube of the closure member has its innermost end connected to a flexible tube 252, with a float, such as a small styrofoam body 254, fixed to the end of the tube, as by suitable adhesive, for example. The float holds the end of the vent tube 252 at the head space of the container (e.g. above the surface of the liquid). For pressure release, in particular, the inner end of the tube 252 should be in the head space. Also, air may flow directly to the head space as liquid is dispensed, instead of having to bubble up through the body of the liquid, which can be undesirable.

As described in connection with the embodiment of FIGS. 1 through 12, the cap assembly includes the spigot base 202 (see also FIGS. 13 and 14), the spigot and the closure barrel. This assembly is handled as a unit and is connected to the container 10 by firmly pressing the spigot base 202 down over the tapered shoulders 50 of the container neck. In automated handling of this assembly, it is necessary to control the position of the long, slender and flexible vent tube 252 and float 254 so that the cap assembly (including the vent tube and float) may be automatically moved into alignment with and then attached to the container neck without the vent tube hanging down or otherwise interfering with the interengagement of the spigot base and container neck. To this end the free end of the tube, that end at which the float 254 is connected, is detachably secured to the inner end of the spigot, as particularly illustrated in FIGS. 22, 23 and 24, and also as illustrated in dotted lines in FIG. 15. The tube is bent in a loop 308 (FIG. 15) with one end permanently secured to closure member vent tube 248, and the other detachably secured to a rigid pin 300. Pin 300 is fixed to the outer side of the inner end of spigot body 204 (FIGS. 16, 17, 18, 22 and 24) and extends in a direction substantially parallel to the axis of the spigot and further inwardly of the innermost spigot end. Pin 300 has an outer diameter that is a hand tight friction fit within the inner bore of vent tube 252, with the free end of the vent tube extending to the free end 302 of float 254, as illustrated in FIGS. 22 and 24.

Before the cap and spigot subassembly are connected to the container neck, the free end of vent tube 252, together with the float, is temporarily mounted upon the inwardly projecting free end of fixed pin 300 of the spigot, with the body of the float adjacent the innermost end of the spigot body 204, and approximately one-half of the end of the float 254 extending radially inwardly of the bore of the spigot body, partially blocking the bore. In this intermediate assembly condition, the closure barrel member 230 is within the spigot body but is in its outer or dispensing position. This is the barrel member position illustrated in FIGS. 18. and 22 In this position the innermost end 304 of the closure barrel member is positioned slightly outwardly of the innermost end 306 of the spigot body 204. Thus there is no interference between the closure barrel member and the float in its secured position. In this intermediate assembly position the spigot and cap have not yet been attached to the bottle neck. To connect the spigot and cap assembly to the container, the subassembly of spigot, spigot base and cap are moved axially toward the neck of the container container so that the now looped bent tube, having an innermost bent end 308, is the first portion of the cap and spigot assembly that enters the container neck. The cap then is pressed axially toward the container neck to interlock the interengaging tapered shoulders that secure the cap assembly to the container neck. During this assembly the barrel closure member is moved to its innermost closed position. As the barrel closure member moves to this innermost closed position, illustrated in FIGS. 16 and 24, the innermost end 304 of the barrel closure moves toward the free end 302 of the float. The barrel closure member end then contacts the float end 302 and pushes the float, together with part of vent tube 252, off of pin 300. It will be seen that the position of pin 300 is such that one edge of the end of tube 252 is positioned radially inwardly of the spigot body 204, and is thus positioned to be contacted by the radially outermost edge of the inner end 306 of the barrel closure member. Thus the closure member will contact both the float and the end of the vent tube as it dislodges these from the retaining pin 300. The float 254 and vent tube 252 are completely disengaged from pin 300 when the barrel closure member has attained its innermost fully closed position, as shown in FIGS. 16 and 24.

When the float is free of pin 300, its buoyancy carries it to the top cf the confined liquid, and thus the free end of the vent tube 252 is positioned in the container head space.

The container preferably is filled (in upright position) while the cap and spigot assembly are detached from the container. After the container has been filled, the cap and spigot assembly, with the closure barrel member in its outermost open position and with the float attached to the retaining pin 300, are attached to the cap by means of the tapered shoulders 50, previously described. The spigot is closed by moving the barrel closure member to its inner closed position in the same motion and at the same time as the cap and spigot assembly are moved to and connected to the container. Thus, as the cap and spigot assembly are connected to the filled container, the closure barrel member is moved to closed position, and the vent tube and float are pushed off the holding pin, causing it to float to the top of the liquid and exposing the end of the tubing to the head space of the container.

For containers in which the contents are dispensed under pressure, such as, for example, a container having a carbon dioxide pressure producing cartridge confined within the container itself, it is desirable to provide a dispensing tube to flow liquid from a lowermost portion of the container to the pour spout. Of course in such a container the spout may have a different configuration (not shown), and a dispensing tube connected to the pour spout itself extends to the bottom of the container. For such a dispensing tube it is desirable to place a weight on the end of the dispensing tube so that the latter may at all times dispense liquid from the container bottom no matter what the level of liquid within the container. In such a configuration, automated assembly also requires that the long, flexible dispensing tube be folded and/or secured to the dispensing spigot during assembly of the spigot to the container. For such a container, a securing pin substantially the same as or identical to float securing pin 300 may be fixed to the cap, as at an inner end of the spigot, with the dispensing tube and weight having an aperture which frictionally receives and retains the weight and dispensing tube upon the pin during assembly of the spigot and cap to the container. Suitable arrangements, such as those described above in connection with FIGS. 22, 23 and 24 may be provided, and the inner end of the closure barrel member may be suitably configured and arranged to dislodge the weight and inner end of the dispensing tube from the retaining pin in a manner similar to that previously described, upon attachment of the cap and spigot assembly to the container body.

Illustrated in FIG. 25 is an alternate arrangement for detachably securing the end of vent tube 252 and float 254 to the spigot. In this arrangement the end of the vent tube and float are secured directly to the spigot base 324 at a position closely adjacent the spigot 320. A rigid retaining pin 326 is fixed to an inner side of the spigot base 324 and spaced from the radially outermost side of the spigot body 328 by a distance that is slightly greater than the radius of float 254. The float, which is adhesively or otherwise secured to the end of vent tube 252, may have a cross section other than rectangular, if deemed necessary or desirable, in order to accommodate the inner concavely curved adjoining of the neck of bottle 10.

In order to dislodge the float 254 from pin 326, after the cap and spigot assembly have been assembled to the container, spigot base 324 is provided with an aperture 330, having a sealing O-ring 332, which slidably and sealingly receives the shank 334 of a plunger 336, having an enlarged head 338. The inner end of the plunger shank 334 is longitudinally split, as indicated at 340, and includes a tapered edge 342 that facilitates assembly of the plunger to the spigot base 324 by insertion of the plunger end through the aperture 330 and O-ring 332.

When the float 254 is attached to the retaining pin 326, the plunger is in its outermost position, namely that illustrated in FIG. 25. After filling the container, attaching the cap and spigot assembly to the container body, and moving the closure barrel to its innermost closed position, the float 254 of FIG. 25 may be dislodged from retaining pin 326 merely by pressing the plunger head 338 inwardly, toward the spigot base. The float, just as before, will then carry the end of vent tube 252 to the container head space.

The container configuration illustrated and described herein is presently preferred. However, it will be appreciated that each of the several spigot assemblies disclosed herein may be used with containers of other configurations, whether or not stackable, and regardless of the nature and mode of support for the container in its dispensing position. A significant advantage of the container configuration disclosed herein is that even though it employs a spigot that projects outwardly of the container envelope (as is desirable for dispensing container contents) when the containers are stacked for storage, handling and transportation, the otherwise projecting spigot no longer projects from the combined envelope of a stack of containers. Moreover, the described containers are quite stable, when in upright storage position, or in horizontal dispensing position, and need no special external stabilizing support.

Although novel dispensing method and apparatus have been described in connection with use for storage and dispensing of draft beer, and particularly for use with plastic containers of smaller size, it will be readily understood that these concepts may be used for other liquids, such as soft drinks or carbonated wines, and may be used with larger metal barrels or other containers of different sizes and configurations.

The foregoing detailed description is to be clearly understood as given by way of illustration and example only, the spirit and scope of this invention being limited solely by the appended claims.

What is claimed is:

1. A dispensing container comprising a container body, a cap assembly including a spigot base and a spigot, said cap assembly being assembled to said container body and fixedly connected in sealed relation thereto, said spigot being fixed to and extending outwardly of said spigot base and having an internal bore in communication with the interior of the container, said spigot having a pour opening and a vent port in communication with said bore, a closure member mounted within the spigot bore for motion axially of the spigot, said closure member having a sealing section including sealing means engaging said bore, said closure member being movable between a closed inner position, wherein said sealing means are positioned inwardly of said pour opening, and an outer dispensing position wherein said sealing means are positioned outwardly of said pour opening, said closure member including a vent tube having a portion within said container for allowing flow of air inwardly through said vent port to the interior of said container, a float on said vent tube portion within said container, float retaining means for detachably securing said float to said cap assembly to facilitate assembly of said cap assembly to said container, and means for detaching said float from said spigot upon assembly of said cap assembly to said container.

2. The container of claim 1 wherein said float retaining means comprises a pin fixed to an inner end of said spigot, said vent tube portion having an opening that receives said pin to detachably secure the float to the spigot before the cap assembly is assembled to said container, said means for detaching comprising an inner end of said closure member.

3. The container of claim 1 wherein said float retaining means comprises a pin fixed to said spigot base adjacent an inner end of said spigot, said vent tube portion having an opening that receives said pin before the cap assembly is assembled to said container, said means for detaching comprising a plunger slidably mounted to said spigot base and extending there through, said plunger having an inner end configured and arranged to be driven inwardly of said spigot base to push against said float.

4. A dispensing container comprising a container body, a spigot fixed to and extending outwardly of said container body and having an internal bore in communication with the interior of the container, said spigot having a pour opening and a vent port in communication with said bore.

a closure member mounted within the spigot bore for motion axially of the spigot, said closure member having a sealing section including sealing means engaging said bore, said closure member being movable from a closed inner position, wherein said sealing means are positioned inwardly of said pour opening, to an outer dispensing position wherein said sealing means are positioned outwardly of said pour opening, said closure member including means for blocking flow of liquid from said container through said vent port while allowing flow of air inwardly through said vent port to the interior of said container, said means for blocking flow comprising a closure sealing wall and passage means extending through said sealing wall in communication with said vent port when said closure member is in said outer dispensing position, said passage means including a conduit connected to said sealing wall and extending to an upper portion of the interior of said container body, a float secured to a portion of said conduit remote from said sealing wall, holding means on an inner portion of said spigot for detachably securing said float, and means on said closure member for detaching said float.

5. A dispensing container comprising a container body, a spigot fixed to and extending outwardly of said container body and having an internal bore in communication with the interior of the container, said spigot having a pour opening and a vent port in communication with said bore, a closure member mounted within the spigot bore for motion axially of the spigot, said closure member having a sealing section including sealing means engaging said bore, said closure member being movable from a closed inner position, wherein said sealing means are positioned inwardly of said pour opening, to an outer dispensing position wherein said sealing means are positioned outwardly of said pour opening, said closure member including means for blocking flow of liquid from said container through said vent port while allowing flow of air inwardly through said vent port to the interior of said container, said means for blocking flow comprising a closure sealing wall and passage means extending through said sealing wall in communication with said vent port when said closure member is in said outer dispensing position, said passage means including a conduit connected to said sealing wall and extending to an upper portion of the interior of said container body, a float secured to a portion of said conduit remote from said sealing wall, and a float retaining pin fixed to said container body adjacent said spigot, said float having an opening, said pin having an end portion received in said float opening and detachably retaining said float adjacent said spigot, said closure member having an end portion configured and arranged to contact the float and detach it from said pin when said closure member moves to said closed inner position.

6. A liquid dispenser comprising a container, a spigot fixed to said container, said spigot comprising:

a hollow spigot body extending outwardly from said container, a pour spout formed on a side of said spigot, a vent port formed in said spigot, a closure member mounted in said spigot body for axial motion relative to the spigot body and having a sealing section in slidable sealing engagement with the interior of said spigot body, said closure member being movable within said spigot body between a closed position in which said spigot is sealed inwardly of said pour spout, and an outer dispensing position displaced axially outwardly along said spigot, said closure member comprising a hollow inner section having a tubular wall open at an inner end and having a sealing wall at said sealing section, a pour opening in said tubular wall configured and arranged to provide liquid communication between the interior of said container and said pour spout in said dispensing position, a vent opening in said sealing wall, and a vent conduit connected between said vent opening and the interior of said container, said vent conduit and vent opening being configured and arranged to provide fluid communication between said vent port and an upper part of the interior of said container in said dispensing position, said spigot having an inner end extending into said container and including a retainer pin fixed to an exterior side of said end of said spigot body, said vent conduit having a free end within said container configured and arranged to detachably receive said retainer pin prior to assembly of said spigot to said container, and a float secured to said conduit free end and extending at least partly across said spigot inner end when said conduit free end receives said retainer pin, said closure member having an inner end extending inwardly of said spigot inner end in said closed position, whereby said closure member inner end will dislodge said float and vent conduit from said retainer pin when said closure member moves toward said closed position.

7. A dispensing spigot assembly for use with a liquid container comprising a spigot adapted to be fixed to and extend outwardly of a container, and having an internal bore for communication with the interior of the container, said spigot having a pour opening and a vent port in communication with said bore, said vent port being positioned outwardly of said pour opening, and a closure member mounted within the spigot bore for motion axially of the spigot, said closure member having a sealing section including sealing means engaging said bore, said closure member being movable from a closed inner position, wherein said sealing means are positioned inwardly of said pour opening, to an outer dispensing position wherein said sealing means are positioned outwardly of said pour opening, said closure member including means for blocking flow of liquid from said bore through said vent port while allowing flow of air inwardly through said vent port and through said bore, said sealing means including a sealing member circumscribing said closure member and engaging said bore between said pour opening and vent port in said dispensing position.

8. The spigot assembly of claim 7 wherein said means for blocking flow comprises a closure sealing wall and passage means extending through said sealing wall in communication with said vent port when said closure member is in said outer dispensing position.

9. The spigot assembly of claim 8 wherein said passage means includes a conduit connected to said sealing wall and extending to an upper portion of the interior of said container body.

10. The spigot assembly of claim 9 including a float secured to a portion of said conduit remote from said sealing wall.

11. The spigot assembly of claim 7 wherein said closure member comprises a tubular barrel body closely received in said spigot and rotatable therein, and interengaging cam means on said barrel body and spigot for effecting relative axial motion of said barrel body and spigot in response to rotation of said barrel body relative to said spigot.

12. The spigot assembly of claim 11 wherein said cam means comprise a closed bottom cam slot formed on said barrel body and extending spirally along said barrel body from an inner end to an outer end of said slot, and a cam follower pin fixed to the spigot and received in said cam slot.

13. A dispensing spigot assembly for use with a liquid container comprising a spigot adapted to be fixed to and extend outwardly of a container, and having an internal bore for communication with the interior of the container, said spigot having a pour opening and a vent port in communication with said bore, and a closure member mounted within the spigot bore for motion axially of the spigot, said closure member having a sealing section including sealing means engaging said bore, said closure member being movable from a closed inner position, wherein said sealing means are positioned inwardly of said pour opening, to an outer dispensing position wherein said sealing means are positioned outwardly of said pour opening, said closure member including means for blocking flow of liquid from said bore through said vent port and through said bore, said spigot including a pressure release port, said closure member being movable to a pressure release position between said inner and outer positions wherein gas is vented through said bore and through said pressure release port while flow of liquid from said bore is blocked.

14. A dispensing spigot assembly for use with a liquid container comprising a spigot adapted to be fixed to and extend outwardly of a container, and having an internal bore for communication with the interior of the container, said spigot having a pour opening and a vent port in communication with said bore, and a closure member mounted within the spigot bore for motion axially of the spigot, said closure member having a sealing section including sealing means engaging said bore, said closure member being movable from a closed inner position, wherein said sealing means are positioned inwardly of said pour opening, to an outer dispensing position wherein said sealing means are positioned outwardly of said pour opening, said closure member including means for blocking flow of liquid from said bore through said vent port and through said bore, said sealing means being positioned between said pour opening and vent port in said outer dispensing position, and including second sealing means on said closure member positioned outwardly of said vent port in said outer dispensing position.

15. A dispensing spigot assembly for use with a liquid container comprising:

a spigot adapted to be fixed to and extend outwardly of a container, and having an internal bore for communication with the interior of the container, said spigot having a pour opening and a pressure release port in communication with said bore, and a closure member mounted within the spigot bore for motion axially of the spigot, said closure member having a sealing section including sealing means engaging said bore, said closure member being movable from a closed inner position, wherein said sealing means are positioned inwardly of said pour opening and said pressure release port, to an outer dispensing position wherein said sealing means are positioned outwardly of said pour opening, said closure member being movable to a pressure release position, said closure member including means operable in said pressure release position for flowing gas from the interior of said container to said pressure release port and including mechanical means operable in said pressure release position for blocking flow of liquid from said container.

16. The spigot assembly of claim 15 wherein said pour spout includes an inward wall, and wherein said pressure release port is formed in said wall.

17. The spigot assembly of claim 16 wherein said release port comprises a narrow channel formed in said wall, and wherein said sealing means, in pressure release position, are positioned inwardly of said pour opening and slightly outwardly of said inward wall.

18. A liquid dispenser comprising:

a container, a spigot fixed to said container, said spigot comprising:

a cylindrical spigot body extending outwardly from said container, a closure member mounted in said spigot body for axial motion relative to the spigot body and having an inner end in slidable, sealing engagement with the interior of said spigot body, said member being movable within said spigot body to an outer dispensing position displaced axially outwardly along said spigot, a pour spout formed on a side of said spigot body, p2 a pressure release port formed in said spigot body adjacent an inward portion of said pour spout, said closure member having a sealing section including sealing means engaging said bore, said closure member being movable from a closed inner position, wherein said sealing means are positioned inwardly of said pour spout and port, to said outer dispensing position wherein said sealing means are positioned outwardly of said pour spout, said closure member being movable to a pressure release position between said inner and outer positions, said enclosure member including means operable in said pressure release position for flowing gas from the interior of said container to said pressure release port and including mechanical means operable in said pressure release position for blocking flow of liquid from said container.

19. The liquid dispenser of claim 18 wherein said pour spout includes an inward wall, said pressure release port extending through said inward wall.

20. The dispenser of claim 18 wherein said sealing means of said closure member are positioned slightly outwardly of said pressure release port in said pressure release position, whereby gas is vented from the interior of said container through said pressure release port and flow of liquid from the container is blocked by said sealing means.

21. The liquid dispenser of claim 18 wherein said pressure release port comprises a bleed passage of decreased area formed on said spigot body inwardly of said pour spout, and wherein said pressure release port is open and said pour spout is closed by said closure member in said pressure release position, and including means for holding said closure member in a selected one of said positions.

* * * * *

UNITED STATES PATENT AND TRADEMARK OFFICE

CERTIFICATE OF CORRECTION

PATENT NO. : 5,118,015

DATED : June 2, 1992

INVENTOR(S) : William R. Scholle et al.

It is certified that error appears in the above-identified patent and that said Letters Patent is hereby corrected as shown below:

On the Title page, item [75] should read as follows:

INVENTOR(S): William R. Scholle
Chester Savage

Signed and Sealed this

Thirty-first Day of August, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,118,015

DATED : June 2, 1992

INVENTOR(S) : William R. Scholle and Chester Savage

It is certified that error appears in the above-identified patent and that said Letters Patent is hereby corrected as shown below:

Claim 18 (Column 24, Line 15) delete "$p^2$".

Signed and Sealed this

Twenty-ninth Day of March, 1994

*Attest:*

Bruce Lehman

BRUCE LEHMAN

*Attesting Officer*

*Commissioner of Patents and Trademarks*